US011958161B2

(12) United States Patent
Kamiki et al.

(10) Patent No.: US 11,958,161 B2
(45) Date of Patent: Apr. 16, 2024

(54) POLISHING APPARATUS HAVING SURFACE-PROPERTY MEASURING DEVICE OF POLISHING PAD AND POLISHING SYSTEM

(71) Applicant: EBARA CORPORATION, Tokyo (JP)

(72) Inventors: Keisuke Kamiki, Tokyo (JP); Toru Maruyama, Tokyo (JP); Yasuyuki Motoshima, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 576 days.

(21) Appl. No.: 17/048,674

(22) PCT Filed: Apr. 25, 2019

(86) PCT No.: PCT/JP2019/017691
§ 371 (c)(1),
(2) Date: Oct. 19, 2020

(87) PCT Pub. No.: WO2019/208712
PCT Pub. Date: Oct. 31, 2019

(65) Prior Publication Data

US 2021/0370461 A1 Dec. 2, 2021

(30) Foreign Application Priority Data

Apr. 26, 2018 (JP) ..... 2018-085143
Apr. 4, 2019 (JP) ..... 2019-071994

(51) Int. Cl.
*B24B 37/005* (2012.01)

(52) U.S. Cl.
CPC ..... *B24B 37/005* (2013.01)

(58) Field of Classification Search
CPC ..... B24B 49/18; B24B 49/186; B24B 53/017; B24B 37/005; B24B 37/10; B24B 37/34; B24B 7/228
(Continued)

(56) References Cited

U.S. PATENT DOCUMENTS 6,126,511 A 10/2000 Hayakawa et al.
2001/0012749 A1 8/2001 Oguri et al.
(Continued)

FOREIGN PATENT DOCUMENTS

CN 201610885 U 10/2010
CN 105983904 A * 10/2016 ..... B24B 37/105
(Continued)

OTHER PUBLICATIONS

English translation of CN105983904A (Year: 2016).*
(Continued)

*Primary Examiner* — Joel D Crandall
*Assistant Examiner* — Sukwoo James Chang
(74) *Attorney, Agent, or Firm* — PEARNE & GORDON LLP

(57) ABSTRACT

The present invention relates to a polishing apparatus having a surface-property measuring device for measuring surface properties of a polishing pad which is used to polish a substrate, such as semiconductor wafer, and a polishing system including such a polishing apparatus. The polishing apparatus includes a surface-property measuring device (30) for measuring surface properties of a polishing pad (2), a support arm (50) for supporting the surface-property measuring device (30), and a moving unit (53) coupled to the support arm (50) and configured to move the surface-property measuring device (30) from a retreat position to a measure position.

4 Claims, 23 Drawing Sheets

(58) Field of Classification Search
USPC ..... 451/5, 8, 10, 21, 56, 72, 443
See application file for complete search history.

(56) References Cited

U.S. PATENT DOCUMENTS

| | | | | |
|---|---|---|---|---|
| 2014/0273752 | A1 | 9/2014 | Bajaj et al. | |
| 2016/0184960 | A1* | 6/2016 | Matsuo | G01N 21/55 451/5 |
| 2017/0190018 | A1* | 7/2017 | Shibuya | B24B 53/007 |
| 2018/0015590 | A1 | 1/2018 | Matsuo | |

FOREIGN PATENT DOCUMENTS

| | | | |
|---|---|---|---|
| JP | H05-312526 | A | 11/1993 |
| JP | H06-160300 | A | 6/1994 |
| JP | H07-311030 | A | 11/1995 |
| JP | H10-197219 | A | 7/1998 |
| JP | H10-296615 | A | 11/1998 |
| JP | H10-315131 | A | 12/1998 |
| JP | 2001-198794 | A | 7/2001 |
| JP | 2006-263876 | A | 10/2006 |
| JP | 2007-019434 | A | 1/2007 |
| JP | 2016-209951 | A | 12/2016 |
| WO | 01/58644 | A1 | 8/2001 |
| WO | 2016-111335 | A1 | 7/2016 |

OTHER PUBLICATIONS

Singapore Written Opinion and Search Report dated Apr. 1, 2022 issued in corresponding Singaporean Patent Application No. 11202010259S.

International Search Report Issued in Patent Application No. PCT/JP2019/017691 dated Jul. 16, 2019.

Written Opinion Issued in Patent Application No. PCT/JP2019/017691 dated Jul. 16, 2019.

* cited by examiner

PRIOR ART

POLISHING APPARATUS HAVING SURFACE-PROPERTY MEASURING DEVICE OF POLISHING PAD AND POLISHING SYSTEM

TECHNICAL FIELD

The present invention relates to a polishing apparatus having a surface-property measuring device for measuring surface properties of a polishing pad used to polish a substrate, such as a semiconductor wafer, and a polishing system including such a polishing apparatus.

BACKGROUND ART

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, using a polishing apparatus, while a polishing liquid is supplied onto a polishing pad, a substrate such as a semiconductor wafer is brought into sliding contact with the polishing pad, so that the substrate is polished. The polishing liquid is, for example, a slurry containing abrasive particles such as silica ($SiO_2$) or ceria ($CeO_2$) therein.

The polishing apparatus for performing the above CMP process includes a polishing table having a polishing pad, and a substrate holding device, which is referred to as a carrier or a top ring, for holding a semiconductor wafer (i.e., substrate). By using such a polishing apparatus, the substrate is held and pressed against the polishing pad under a predetermined pressure by the substrate holding device, thereby polishing an insulating film or a metal film on the substrate.

After one or more substrates have been polished, abrasive particles in a polishing liquid or ground-off particles of the substrate are attached to the surface of the polishing pad, and surface configuration or surface condition of the polishing pad is changed, resulting in deterioration in polishing performance. Therefore, as the substrates are repeatedly polished by the same polishing pad, a polishing rate is lowered and nonuniform polishing action is caused. Thus, dressing (conditioning) of the polishing pad is performed using a dresser to regenerate the surface configuration or surface condition of the polishing pad which has deteriorated.

A surface topography and condition of the polishing pad, i.e., surface properties of the polishing pad, are one of factors that determine a CMP performance. Therefore, it is preferred to directly measure the surface properties of the polishing pad and to reflect the measured data in dressing conditions. Thus, in a conventional polishing apparatus, by using a device for directly measuring the surface properties, the dressing conditions have been determined. In the present specification, the device for measuring the surface properties of the polishing pad is referred to as "a surface-property measuring device".

Patent document 1 describes a surface-property measuring device which applies a laser beam to a polishing pad, and receive light reflected by the polishing pad to obtain reflection intensities at each reflection angle. A polishing apparatus described in Patent document 1 obtains surface properties of the polishing pad based on a reflection intensity distribution obtained by the surface-property measuring device, and determine dressing conditions based on the obtained reflection intensity distribution. According to this polishing apparatus, dressing conditions are changed depending on a change in the surface properties of the polishing pad, enabling the surface properties of the polishing pad to be kept in a state required to ensure CMP performance. Further, the surface properties of the polishing pad can be directly measured, preventing CMP process from performing in abnormal conditions.

CITATION LIST

Patent Literature

Patent document 1: International Patent Publication No. 2016/111335

SUMMARY OF INVENTION

Technical Problem

However, in conventional polishing apparatuses, the surface-property measuring device has not been installed permanently. In other words, the surface-property measuring device has been attached to the polishing apparatus each time measurement of the surface properties of the polishing pad is intended, and detached after measurement of the surface properties of the polishing pad.

FIG. 30 is a schematic view showing an example of a surface-property measuring device attached to a conventional polishing apparatus. As shown in FIG. 30, the polishing apparatus has a holding plate 215 configured to be able to attach and detach the surface-property measuring device 230, and this holding plate 215 is suspended from a frame (not shown) of the polishing apparatus. When surface properties of a polishing pad 202 are measured, an operator attaches the surface-property measuring device 230 to a lower end of the holding plate 215 after stopping operation of the polishing apparatus. After measurement of the surface properties of the polishing pad 202, the operator detaches the surface-property measuring device from the holding plate 215, and then operation of the polishing pad is started.

In this manner, in the conventional polishing apparatus, measurement of the surface properties of the polishing pad 202 is performed as an independent operation that is separated from the operation of the polishing apparatus. Therefore, in order to measure the surface properties of the polishing pad 202 in the conventional polishing apparatus, it is necessary to stop the operation of the polishing apparatus once, resulting in decreasing the throughput of the polishing apparatus. Further, the attaching and detaching operations of the surface-property measuring device 230 are very cumbersome and time-consuming for the operator. Therefore, a polishing apparatus capable of automatically measuring the surface properties of the polishing pad 202 is desired.

It is therefore an object of the present invention to provide a polishing apparatus capable of automatically measuring surface properties of a polishing pad to increase a throughput of the polishing apparatus. Further, it is also an object of the present invention to provide a polishing system including such a polishing apparatus.

Solution to Problem

In one embodiment of the present invention, there is a polishing apparatus, comprising: a surface-property measuring device configured to measure surface properties of a polishing pad; a support arm for supporting the surface-property measuring device; and a moving unit coupled to the support arm and configured to automatically move the surface-property measuring device from a retreat position to a measure position.

In a preferred embodiment of the present invention, the moving unit includes: a fixed block which is fixed to the polishing apparatus; a pivot block which is coupled to the support arm; a rotational shaft for pivotably coupling the pivot block to fixed block; and a pivot mechanism for pivoting the pivot block.

In a preferred embodiment of the present invention, the pivot mechanism is a piston-cylinder mechanism constructed of a piston coupled to the pivot block, and a cylinder in which the piston is housed so as to be movable back and forth.

In a preferred embodiment of the present invention, the rotational shaft is fixed to the pivot block, and the moving mechanism is a motor coupled to the rotational shaft.

In a preferred embodiment of the present invention, the polishing apparatus further comprises a position adjusting mechanism for automatically adjusting an attitude of the surface-property measuring device such that a lower surface of the surface-property measuring device moved to the measure position becomes to be parallel to a surface of the polishing pad, wherein the position adjusting mechanism has a support base disposed below the support arm, and at least one adjustment pin which is fixed to an upper surface of the surface-property measuring device, and extends through a through-hole formed in the support base, and the adjustment pin has a pin body having a diameter smaller than a diameter of the through-hole, and a pin head located above the through hole and having a size larger than the diameter of the through-hole.

In a preferred embodiment of the present invention, the surface-property measuring device includes a nozzle configured to eject a pressurized gas obliquely with respect to a polishing surface of the polishing pad.

In a preferred embodiment of the present invention, the surface-property measuring device has a casing in which a measuring structure for measuring the surface properties of the polishing pad is housed, the casing has a cutout formed in a bottom thereof, and the nozzle is configured to eject the pressurized gas so as to flow the pressurized In a preferred embodiment of the present invention, the polishing apparatus further comprises a displacement mechanism for adjusting a position of the surface-property measuring device with respect to the polishing pad along the support arm, wherein the displacement mechanism includes: a slotted hole extending along the support arm; a support shaft inserted into the slotted hole, and the support shaft has a shaft body coupled to the surface-property measuring device, and a shaft head which is in contact with a stepped portion formed inside the slotted hole to thereby support the surface-property measuring device coupled to the shaft body.

In a preferred embodiment of the present invention, the displacement mechanism further includes a piston coupled to the surface-property measuring device, and a cylinder in which the piston is housed so as to be movable back and forth, and the cylinder of the displacement mechanism is fixed to the support arm.

In a preferred embodiment of the present invention, the pivot block is constructed of a first plate coupled to the support arm and a second plate coupled to the fixed block, and the second plate is pivotably coupled to the first plate via a rotational pin.

In a preferred embodiment of the present invention, the polishing apparatus further comprises a dresser configured to dress a surface of the polishing pad, wherein the surface-property measuring device is mounted to the dresser, the support arm is a dresser arm for rotatably supporting a dresser shaft coupled to the dresser, and the moving mechanism includes an elevating actuator for moving the dresser shaft up and down with respect to the dresser arm, and a rotational actuator for pivoting the rotational shaft coupled to the dresser arm.

In a preferred embodiment of the present invention, the surface-property measuring device measures the surface properties of the polishing pad in the middle of dressing process of the polishing pad.

In a preferred embodiment of the present invention, a dressing member provided at the dresser has a ring shape having a through-hole extending from an upper surface to a lower surface thereof, and the surface-property measuring device measures the surface properties of the polishing pad through the through-hole of the dressing member.

In a preferred embodiment of the present invention, the surface-property measuring device comprises of a plurality of surface-property measuring devices mounted to the dresser.

In a preferred embodiment of the present invention, some of the plurality of surface-property measuring devices are surface-property measuring devices configured to apply a laser beam to the polishing pad and to receive reflected light that is reflected by the surface of the polishing pad, thereby measuring the surface properties of the pad.

In a preferred embodiment of the present invention, some of the plurality of surface-property measuring devices are surface-property measuring devices configured to measure the surface properties of the pad from image information of a surface of the polishing pad acquired by an imaging device.

In a preferred embodiment of the present invention, a dressing member provided at the dresser has a ring shape having a through-hole extending from an upper surface to a lower surface thereof, and one of the plurality of surface-property measuring devices measures the surface properties of the polishing pad through the through-hole of the dressing member.

In one embodiment of the present invention, there is a polishing system, comprising: said polishing apparatus; and a processing system in which data of the surface properties of the polishing pad obtained by use of a surface-property measuring device of the polishing apparatus is inputted, wherein the processing system includes: an input section in which the data of the surface properties of the polishing pad outputted from the polishing apparatus is inputted; a processing section which determines dressing conditions based on the data of the surface properties of the polishing pad inputted to the input section; and an output section which outputs the dressing condition, determined by the processing section, to the polishing apparatus, and the polishing apparatus is configured to dress the polishing pad based on the dressing conditions outputted from the output section.

In a preferred embodiment of the present invention, the processing system further includes a storage section which stores in advance teacher data for determining the dressing conditions, and the processing section of the processing system determines the dressing conditions of the polishing apparatus based on the teacher data.

In a preferred embodiment of the present invention, the polishing apparatus transmits data of the surface properties of the polishing pad, which is obtained after dressing of the polishing pad, to the input section of the processing system, and the processing section of the processing system determines necessity of dressing, necessity of additional dressing, and replacement of a dresser, based on the data of the surface properties of the polishing pad which is obtained after dressing.

In a preferred embodiment of the present invention, the polishing apparatus transmits data of the surface properties of the polishing pad, which is obtained during dressing of the polishing pad, to the input section of the processing system, and the processing section modifies, based on the data of the surface properties of the polishing pad during dressing, the dressing conditions in the middle of dressing process of the polishing pad.

In a preferred embodiment of the present invention, the processing system is connected the polishing apparatus through network.

Advantageous Effects of Invention

According to the present invention, the surface-property measuring device can be automatically moved to the measure position by the moving unit to measure the surface properties of the polishing pad. Therefore, a throughput of the polishing apparatus can be increased. Further, an operator is not necessary to perform operations of attaching and detaching the surface-property measuring device, thereby resulting in reducing burden of the operator.

DESCRIPTION OF EMBODIMENTS

Embodiments according to the present invention will be described below with reference to the drawings.

Figure 1:
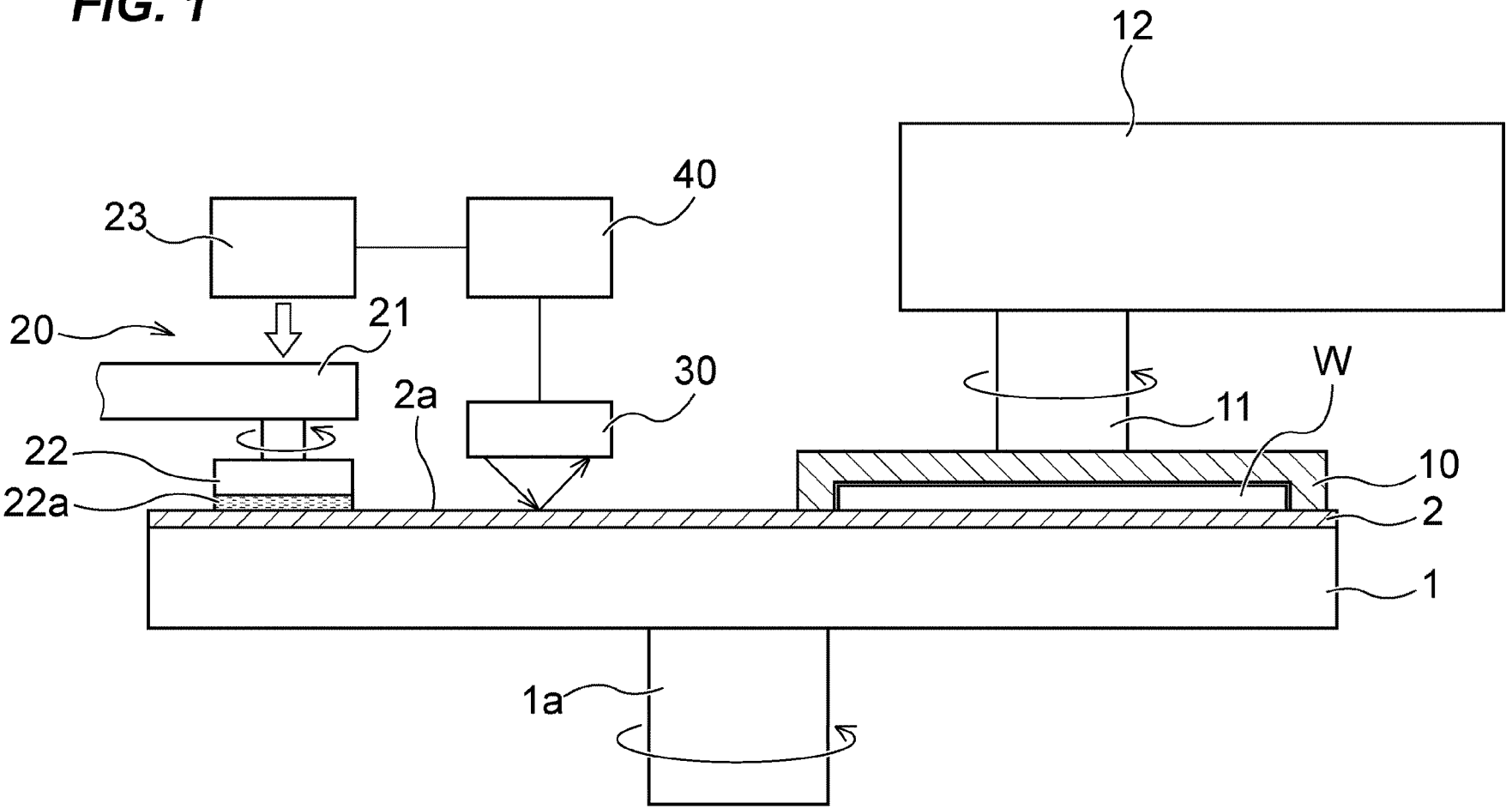
FIG. 1 is a schematic view showing a polishing apparatus according to an embodiment.

FIG. 1 is a schematic view showing a polishing apparatus according to an embodiment. The polishing apparatus (CMP apparatus) shown in FIG. 1 includes a polishing table 1, and a carrier 10 for holding a substrate W such as a semiconductor wafer as an object to be polished and pressing the substrate against a polishing pad on the polishing table. The polishing table 1 is coupled via a table shaft 1*a* to a polishing table rotating motor (not shown) disposed below the polishing table 1. Thus, the polishing table 1 is rotatable about the table shaft 1*a*. A polishing pad 2 is attached to an upper surface of the polishing table 1. An upper surface of the polishing pad 2 constitutes a polishing surface 2*a* for polishing the substrate W. A polishing liquid supply nozzle (not shown) is provided above the polishing table 1 to supply a polishing liquid (slurry) onto the polishing pad 2 on the polishing table 1.

The carrier 10 is connected to a shaft 11, and the shaft 11 is vertically movable with respect to a carrier arm 12. When the shaft 11 moves vertically, the carrier 10 is lifted and lowered as a whole for positioning with respect to the carrier arm 12. The shaft 11 is configured to be rotated by driving a motor (not shown). The carrier 10 is rotated about an axis of the shaft 11.

As shown in FIG. 1, the carrier 10 is configured to hold the substrate W such as a semiconductor wafer on its lower surface. The carrier arm 12 is configured to be pivotable, and thus the carrier 10, which holds the substrate W on its lower surface, is movable from a position at which the carrier 10 receives the substrate to a position above the polishing table 1 by pivotable movement of the carrier arm 12. Then, the carrier 10 holds the substrate W on its lower surface and presses the substrate W against the surface (polishing surface) of the polishing pad 2. At this time, while the polishing table 1 and the carrier 10 are respectively rotated, a polishing liquid (slurry) is supplied onto the polishing pad 2 from the polishing liquid supply nozzle 3 provided above the polishing table 1. The polishing liquid containing silica ($SiO_2$) or ceria ($CeO_2$) as abrasive particles is used. In this manner, while the polishing liquid is supplied onto the polishing pad 2, the substrate W is pressed against the polishing pad 2 and is moved relative to the polishing pad 2 to polish an insulating film, a metal film or the like on the substrate. Examples of the insulating film include $SiO_2$, and examples of the metal film include a Cu film, a W film, a Ta film and a Ti film.

As shown in FIG. 1, the polishing apparatus has a dressing apparatus 20 for dressing the polishing pad 2. The dressing apparatus 20 includes a dresser arm 21, and a dresser 22 which is rotatably attached to the dresser arm 21. The lower part of the dresser 22 comprises a dressing member 22*a*, and the dressing member 22*a* has a circular dressing surface. Hard particles are fixed to the dressing surface by electrodeposition or the like. Examples of the hard particles include diamond particles, ceramic particles and the like. A motor (not shown) is provided in the dresser arm 21, and the dresser 22 is rotated by the motor. The dresser arm 21 is coupled to a lifting and lowering mechanism (not shown), and the dresser arm 21 is lowered by the lifting and lowering mechanism to allow the dressing member 22*a* to be pressed against the polishing surface 2*a* of the polishing pad 2.

The dressing apparatus 20 is connected to a controller 23, and dressing conditions are controlled by the controller 23. In the present embodiment, this controller 23 is configured to control an overall operation of the polishing apparatus including the dressing apparatus 20.

As shown in FIG. 1, the polishing apparatus has a surface-property measuring device 30 of the polishing pad for measuring surface properties such as surface topography or surface condition of the polishing pad 2. In the present embodiment, the surface-property measuring device 30 is configured to apply a laser beam to the polishing pad 2 and to receive reflected light that is reflected by the surface of the polishing pad 2, thereby measuring surface properties of the pad. The surface-property measuring device 30 of the polishing pad is connected to a processor 40.

In the polishing apparatus configured as shown in FIG. 1, the distribution of reflected light from the pad surface obtained in the surface-property measuring device 30 of the polishing pad is arithmetically calculated to obtain a surface property value of the pad in the processor 40, and the calculated result is transferred to the controller 23. In the controller 23, dressing conditions are determined based on the received surface property value of the pad. The dressing apparatus 20 performs the operations according to the dressing conditions determined by the controller 23, thereby dressing the pad surface by the dresser 22.

Figure 2:
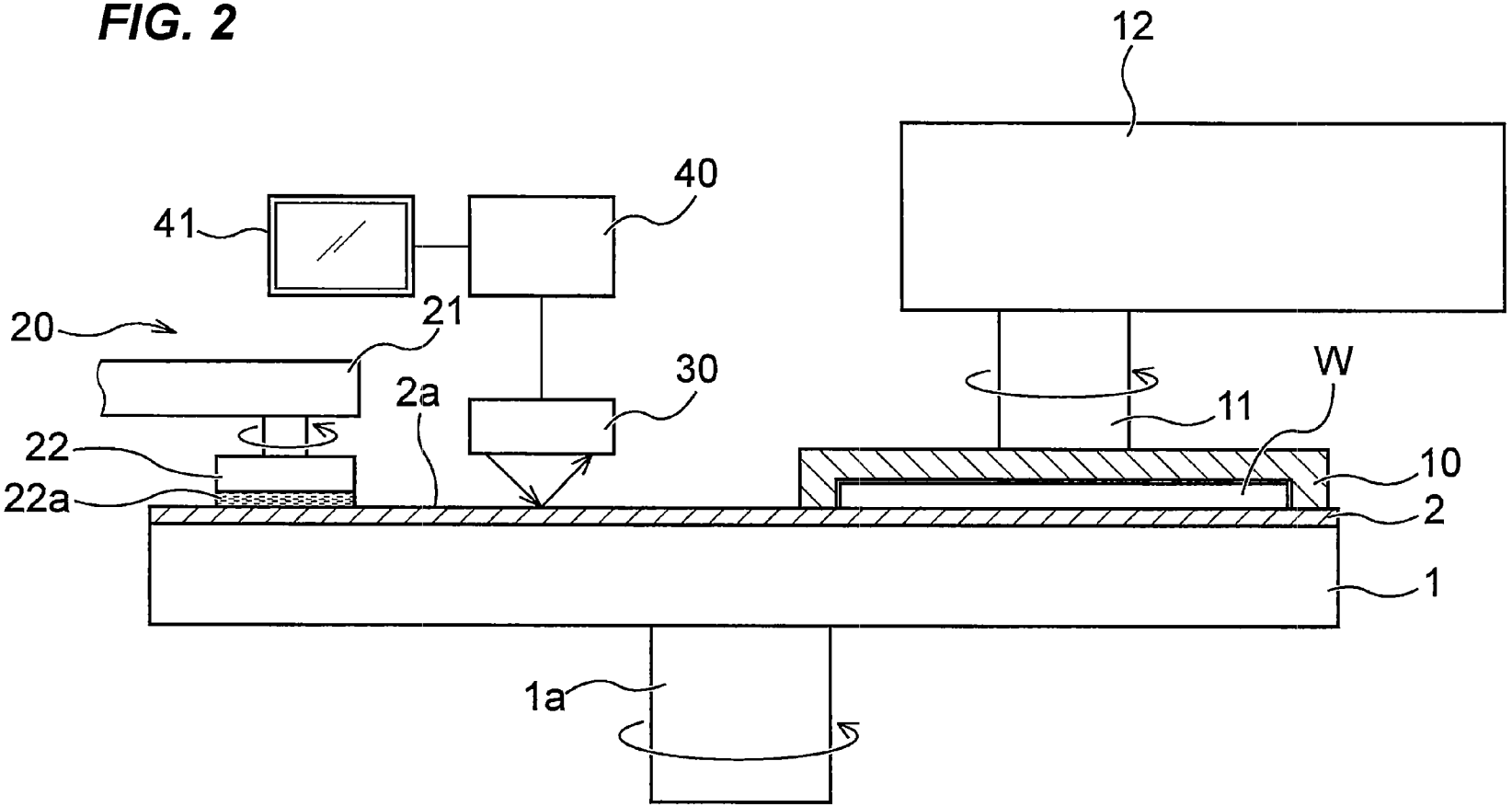
FIG. 2 is a schematic view showing the polishing apparatus according to another embodiment.

FIG. 2 is a schematic view showing the polishing apparatus according to another embodiment. The polishing apparatus shown in FIG. 2 has a polishing unit including a polishing table 1 to which a polishing pad 2 is attached, a carrier 10, and the like, and a dressing apparatus 20, as with the polishing apparatus shown in FIG. 1. Further, the polishing apparatus shown in FIG. 2 has a surface-property measuring device 30 and a processor 40, as with the polishing apparatus shown in FIG. 1. The processor 40 is connected to a display unit 41. Although, in FIG. 2, the controller 23 is omitted from illustration, the polishing apparatus shown in FIG. 2 also has the controller 23, as with the polishing apparatus shown in FIG. 1.

In the polishing apparatus shown in FIG. 2, the distribution of reflected light from the pad surface obtained in the surface-property measuring device 30 is arithmetically calculated to obtain a surface property value of the pad in the processor 40, and the calculated result is displayed in the display unit 41.

Figure 3:
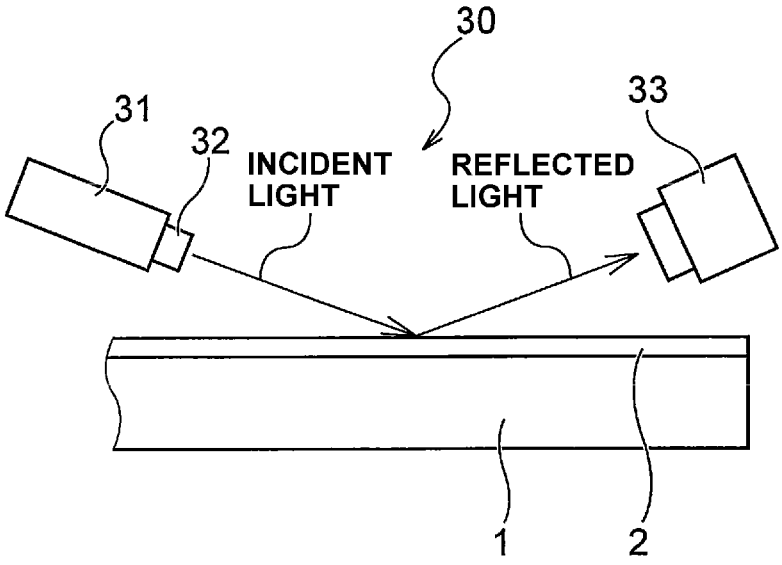
FIG. 3 is a schematic view showing an example of an internal structure (measuring structure) of a surface-property measuring device shown in FIGS. 1 and 2.

FIG. 3 is a schematic view showing an example of an internal structure (measuring structure) of the surface-property measuring device 30 shown in FIGS. 1 and 2. As shown in FIG. 3, the surface-property measuring device 30 includes a light source 31 for emitting a laser beam, a light emitter 32 for leading the laser beam emitted from the light source 31 to the surface of the polishing pad 2 on the polishing table 1, and a light receiver 33 for receiving reflected light that is reflected by the surface of the polishing pad 2. Therefore, the laser beam emitted from the light source 31 is led to the surface of the polishing pad 2 through the light emitter 32, and reflected light that is reflected by the surface of the polishing pad 2 is received by the light receiver 33. The light receiver 33 is connected to the processor 40 (see FIGS. 1 and 2).

Figure 4:
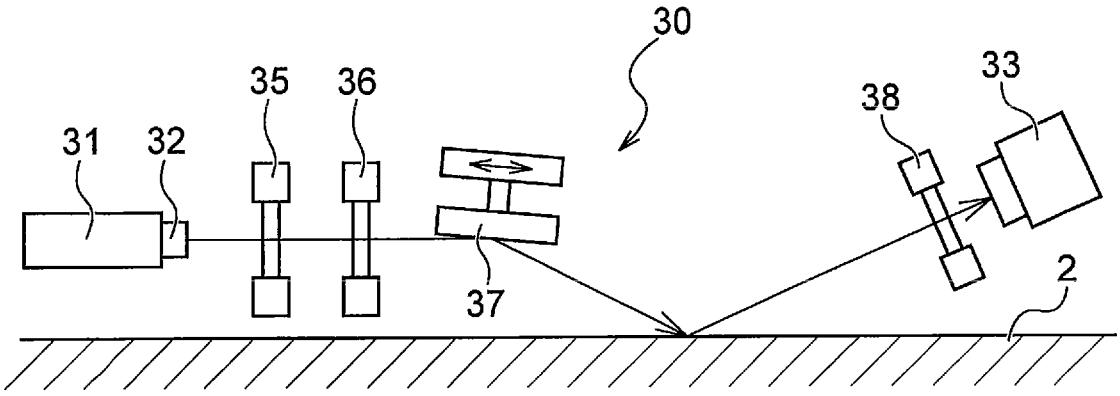
FIG. 4 is a schematic view showing another example of the internal structure (measuring structure) of the surface-property measuring device shown in FIGS. 1 and 2.

FIG. 4 is a schematic view showing another example of the internal structure (measuring structure) of the surface-property measuring device 30 shown in FIGS. 1 and 2. As shown in FIG. 4, the surface-property measuring device 30 includes a light source 31 for emitting a laser beam, a light emitter 32 for leading the laser beam emitted from the light source 31 in a predetermined direction, and a polarizer 35, an ND filter (neutral density filter), and a mirror 37 which are arranged in series along an optical path of the laser beam emitted from the light emitter 32. The mirror 37 is configured to allow an optical path to be changeable by reflecting the laser beam emitted from the light emitter 32 to adjust an incident angle of the laser beam applied to the polishing pad 2. Further, a bandpass filter 38 is disposed before the light receiver 33 on an optical path of the reflected light that is reflected by the surface of the polishing pad 2. Therefore, the laser beam emitted from the light source 31 is s-polarized by the polarizer 35, and is then adjusted in light quantity by the ND filter 36 and applied to the mirror 37 whose angle has been adjusted in advance. Then, the laser beam is reflected by the mirror 37 to change its optical path and is then applied to the surface of the polishing pad 2. The reflected light that is reflected by the surface of the polishing pad 2 enters the bandpass filter 38 which allows only the light having a particular wavelength range to pass therethrough, and the reflected light having the particular wavelength range is received by the light receiver 33.

The light receiver 33 shown in FIGS. 3 and 4 comprises, for example, a linear or planar CCD element or CMOS element whose size can receive fourth-order diffracted light at the highest or seventh-order diffracted light at the highest of the laser beam reflected from the polishing pad 2. The laser beam that has been applied to the surface of the polishing pad 2 is reflected not only at a regular angle (regular reflection) but also at a wide angle through diffraction phenomenon depending on the surface properties of the pad. Specifically, the light receiver 33 receives the laser beam that has not only a regular reflection component but also reflection components reflected at a wide angle, and the received laser beam is analyzed to obtain information of the surface properties of the pad. A linear or planar light receiving element is necessary for receiving the laser beam reflected at the wide angle. Because it is known that the surface properties of the pad which determine the CMP performance is included in, preferably seventh-order diffracted light at the highest, practically fourth-order diffracted light at the highest, the light receiving element whose size can receive the diffracted light of this range is necessary. Therefore, it is preferable to use a light receiving element whose size can receive the diffraction light in this range as the light receiver 33 of the surface-property measuring device 30.

Although, in the present embodiment, the surface-property measuring device 30 is configured to apply the laser beam to the polishing pad 2 and receive the reflected light that is reflected by the surface of the polishing pad 2, thereby measuring surface properties of the pad, the present invention is not limited to this example. For example, the surface-property measuring device 30 may include any imaging device that acquires an image of the surface of the polishing pad 2 (i.e., the polishing surface 2*a*), and be configured to measure the surface properties of the pad from image information of the pad surface acquired by the imaging device. Examples of the imaging device may include an imaging device with CCD image sensor, an imaging device with CMOS image sensor, and an imaging device with TDI (time delay and integration) image sensor. Alternatively, the imaging device may be a video camera device that acquires continuous images (i.e., video) over time.

Next, operation of the polishing apparatus having the surface-property measuring device of the polishing pad configured as shown in FIGS. 1 through 4 will be described. A laser beam is emitted from the light source 31, and the laser beam is applied to the surface of the polishing pad 2. By receiving the laser beam reflected by the surface of the polishing pad 2, information of the surface of the polishing pad 2 is measured. The processor 40 converts a reflection intensity distribution obtained in the surface-property measuring device 30 of the polishing pad to a spatial wavelength spectrum of the surface of the polishing pad by performing a Fourier transform. Further, the processor 40 arithmetically calculates the spatial wavelength spectrum to obtain a surface property value of the pad. Here, this calculation is performed by dividing a sum of reflection intensity of a predetermined spatial wavelength range by a sum of reflection intensity of a wider spatial wavelength range to obtain a surface property value of the pad.

Here, the reflection intensity distribution is defined as a distribution of the received light intensity in each light receiving position of the linear or planar light receiving element. The linear or planar CMOS element or CCD element serving as a light receiving element has a number of light receiving pixels, and can detect received light intensity on a pixel to pixel basis. The light receiving position is changed depending on a reflection angle at the time when the applied laser beam is reflected by the surface of the pad, and the received light intensity is changed depending on the surface properties of the pad. Specifically, a characteristic reflection intensity distribution corresponding to the surface properties of the pad can be obtained by capturing reflection intensities with respect to the respective reflection angles depending on the surface properties of the pad. Further, the spatial wavelength spectrum is defined as a spectrum obtained by performing a Fourier transform on the reflection intensity distribution, and shows a distribution of the received light intensity in each spatial wavelength of the pad surface. For example, in the case where the measured pad surface has a configuration comprising a combination of a wavelength A and a wavelength B primarily, the spatial wavelength spectrum has main peaks at the wavelength A and the wavelength B.

The spatial wavelength spectrum should be such that a sufficiently wide wavelength range is obtained with respect to nth-order diffracted light at the highest which includes the surface properties of the pad for determining the CMP performance. It is known that the nth-order diffracted light to be obtained is preferably seventh-order diffracted light, practically fourth-order diffracted light. In the case where the surface properties of the pad is evaluated, only the intensity of a predetermined spatial wavelength range related to the CMP performance should be extracted. However, in the obtained spatial wavelength spectrum, generally, random noise with respect to the entire wavelength range is contained. Therefore, the following approach is taken: A ratio of an integrated value of reflection intensity of a predetermined spatial wavelength range to an integrated value of reflection intensity of a wider spatial wavelength range is obtained to exclude an influence of the noise, and only the reflection intensity of the predetermined spatial wavelength range is evaluated.

As described above, the ratio of an integrated value of reflection intensity of a predetermined spatial wavelength range to an integrated value of reflection intensity of a wider spatial wavelength range is obtained, and this ratio is defined as "wavelength constituent ratio" as an index for characterizing the surface properties of the pad. It shows that as the wavelength constituent ratio is larger, the reflection intensity of the predetermined spatial wavelength range is relatively larger. Thus, it shows that the measured pad surface contains more predetermined spatial wavelength component. Because it has been examined in advance that the magnitude of the predetermined spatial wavelength component has a strong connection with the CMP performance, the CMP performance can be estimated by the wavelength constituent ratio of the measured pad surface.

The controller 23 obtains a surface property value of the pad determined by the processor 40, and calculates suitable dressing conditions by a closed-loop control based on the obtained value. For example, the dressing conditions are calculated so that the surface property value of the pad remains within a preset predetermined range. In this case, the controller 23 obtains a relational expression showing a relation between the dressing conditions and the surface property value of the pad in advance, and determines suitable dressing conditions by the above expression. Here, the dressing conditions mainly include a polishing pad rotational speed, a dresser rotational speed, a dressing load, a dresser swinging speed, and the like. The determined dressing conditions are transmitted to the dressing apparatus 20, and the dressing apparatus 20 performs dressing of the polishing pad 2 by applying certain dressing conditions.

For example, in the case where the dressing load is an object to be controlled as one of dressing conditions, the relationship between the dressing load and the surface properties of the pad is obtained in advance. Specifically, if the dressing load increases, how much degree the surface property value increases or decreases is obtained in advance. Then, a preset ideal surface property value of the pad and the measured surface property value of the pad are compared, and if there is a difference therebetween, the dressing load is established based on the above relationship so that the surface property value of the pad approaches the ideal surface property value of the pad.

Further, the surface property value of the pad obtained by the processor 40 can be used for detection of an abnormality. In this case, the surface property value of the pad and its time-dependent change are measured, and if these values fall outside preset values, an occurrence of an abnormality of the surface properties of the pad is determined. Then, 1) An alarm of the abnormality is issued. 2) An alarm of the necessity for replacing the dresser is issued.

In one embodiment, the determination of the dressing conditions is as follows: A difference between the measured surface property value of the pad and a preset desired surface property value of the pad is obtained as a desired surface property variation of the pad, and the desired surface property variation of the pad is assigned to a regression equation prepared by obtaining in advance the relationship between a variation of at least one of a dressing load, a dresser rotational speed, a polishing pad rotational speed, and a dresser swinging speed and a surface property variation of the pad to determine at least one of the dressing load, the dresser rotational speed, the polishing pad rotational speed, and the dresser swinging speed.

According to the above embodiment, the regression equation representing the relationship between the dressing conditions (a dressing load, a dresser rotational speed, a polishing pad rotational speed, a dresser swinging speed, and the like) and the surface property value of the pad (wavelength constituent ratio) is obtained in advance, and a variation of the measured surface property value of the pad is assigned to the regression equation. Thus, optimum dressing conditions for obtaining the desired surface property value of the pad can be uniquely obtained.

The regression equation is expressed as $dR=A\times dL+B$, for example. Here, dR represents a variation of a surface property value of the pad (wavelength constituent ratio), dL represents a variation of a dressing load, and A and B are constant. According to the above method for determining the dressing conditions, an effect of keeping the surface properties of the pad constant from an initial stage of usage of the pad to a terminal stage of usage of the pad can be achieved. The surface properties of the pad are changed from an initial stage of usage of the pad to a terminal stage of usage of the pad by an amount of wear of the pad or a degree of sharpness of the dresser, and the CMP performance is also changed according to such change. To keep the surface properties of the pad constant leads to keep the CMP performance constant.

Further, the display unit 41 is configured to display at least one of a state of the dresser 22 and a state of the polishing pad 2 after the obtained surface property value of the polishing pad 2 and the preset surface property value of the pad are compared by the processor 40. The display unit 41 may be configured to display at least one of the state of the dresser 22 and the state of the polishing pad 2 based on the surface properties of the polishing pad 2 obtained by the processor 40 without the above comparison.

The polishing apparatus may have an abnormality judgement unit for judging an abnormality of the surface properties of the polishing pad when the obtained surface property value of the polishing pad is compared with a preset range of the surface property value of the pad in the processor 40 (see FIGS. 1 and 2), and falls outside the preset range. When the abnormality is judged in the abnormality judgement unit, the display unit 41 (see FIG. 2) issues an alarm of the abnormality.

The following is typical types of the abnormality of the surface properties of the pad.

1) There are abnormal spots (defects) in the surface of the pad.
2) Dressing of the polishing pad is insufficient.
3) The dresser reaches the end of life.
4) The pad reaches the end of life.

In the case of 1), when the surface properties of the pad are measured at a plurality of spots, if there is a spot where a great difference occurs compared to other measuring spots, then such spot is judged as an abnormality of the pad and an alarm is issued.

In the case of 2), if the surface property value of the polishing pad exceeds an upper limit of the preset predetermined range, the pad is judged to require an additional dressing and an alarm is issued.

In the cases of 3) and 4), a change in the surface properties of the pad with time (in each of the number of the processed substrates) is measured, and if the measurement falls outside the preset range, the pad (or the dresser) is judged to reach the end of life and an alarm is issued.

As shown in FIG. 4, the surface-property measuring device 30 has the optical fiber 34, the polarizer 35, the ND filter 36, the mirror 37, the bandpass filter 38, and the like to improve the measurement accuracy further and to enhance the degree of freedom of installation. Further, by s-polarizing the laser beam emitted from the light source 31 with the polarizer 35 and then applying the laser beam to the polishing pad 2, the reflectance at the surface of the polishing pad can be increased. Furthermore, by using the ND filter 36, the light quantity of the laser beam can be decreased and adjusted to a desired value, and then the laser beam of the desired light quantity can be applied to the polishing pad 2. On the other hand, by providing the bandpass filter 38 on the optical path of the reflected light that is reflected by the surface of the polishing pad 2, only the reflected light having a wavelength within ±5 nm with respect to the wavelength of the laser beam of the light source 31 can pass therethrough. In the present embodiment, as a laser beam of the light source 31, a laser beam whose wavelength is 635 nm is used. In this manner, by providing the bandpass filter 38, only the reflected light having a wavelength within ±5 nm with respect to the wavelength of the laser beam of the light source 31 can pass therethrough, and thus an influence of the surrounding environment light which becomes noise can be reduced.

The internal structure (measuring structure) is not limited to the embodiments shown in FIGS. 3 and 4. For example, the surface-property measuring device 30 may have an optical fiber for leading the laser beam emitted from the light source 31 in a desired direction. With this structure, the degree of freedom of installation in the optical system of the surface-property measuring device 30 of the polishing pad can be enhanced. Further, the mirror 37 of the surface-property measuring device 30 may be configured to allow its inclination angle to be changed. Changing of the inclination angle of the mirror 37 enables an angle at which the laser beam enters the polishing pad 2 to be adjusted. Further, the light source 31 and/or the light receiver 33 may be configured to be swingable. The surface-property measuring device 30 may have a plurality of light sources 31, and may have a plurality of light receivers 33.

Figure 5:
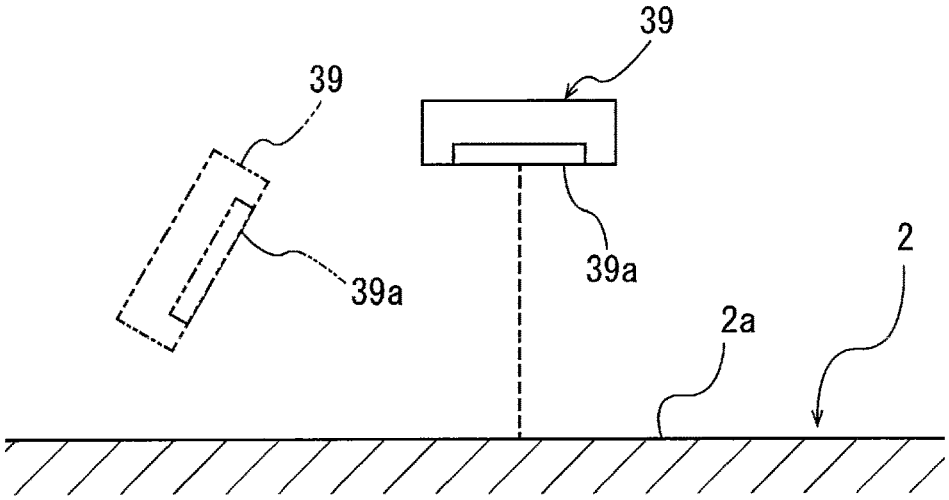
FIG. 5 is a schematic view showing still another example of the internal structure (measuring structure) of the surface-property measuring device shown in FIGS. 1 and 2.

FIG. 5 is a schematic view showing still another example of the internal structure (measuring structure) of the surface-property measuring device 30 shown in FIGS. 1 and 2. The surface-property measuring device 30 shown in FIG. 5 has, instead of the light source 31 and the light receiver 33, an imaging device 39 for acquiring image information of the surface properties of the polishing pad 2. The imaging device 39 is, for example, a digital camera with CCD image sensor, or with CMOS image sensor. The imaging device 39 may be a digital camera with TDI image sensor, or a video camera for capturing video. The imaging device 39 is connected to the controller 23 through the processor 40.

In the present embodiment, an imaging surface 39*a* of the imaging device 39 is face-to-face with the polishing surface 2*a* of the polishing pad 2. More specifically, the imaging surface 39*a* of the imaging device 39 is parallel to the polishing surface 2*a* of the polishing pad 2. In one embodiment, the imaging device 39 may be disposed so as to incline the imaging surface 39*a* thereof with respect to the polishing surface 2*a* of the polishing pad 2 (see an imaging device 39 illustrated as double-dotted line in FIG. 5). Although not shown, the surface-property measuring device 39 may have a light source for illuminating the polishing surface 39 to be captured by the imaging device 39.

The image information of the polishing pad 2 acquired by the imaging device 39 is sent to the processor 40, and then the processor 40 arithmetically calculates the surface property value of the pad. As described above, the controller 23 obtains the surface property value of the pad determined by the processor 40, and calculates suitable dressing conditions by a closed-loop control based on the obtained value. The polishing apparatus may be configured to issue an alarm when the surface property value of the polishing pad, obtained in the processor 40 (see FIGS. 1 and 2), is compared with a preset range of the surface property value of the pad in the processor 40, and falls outside the preset range.

Figure 6:
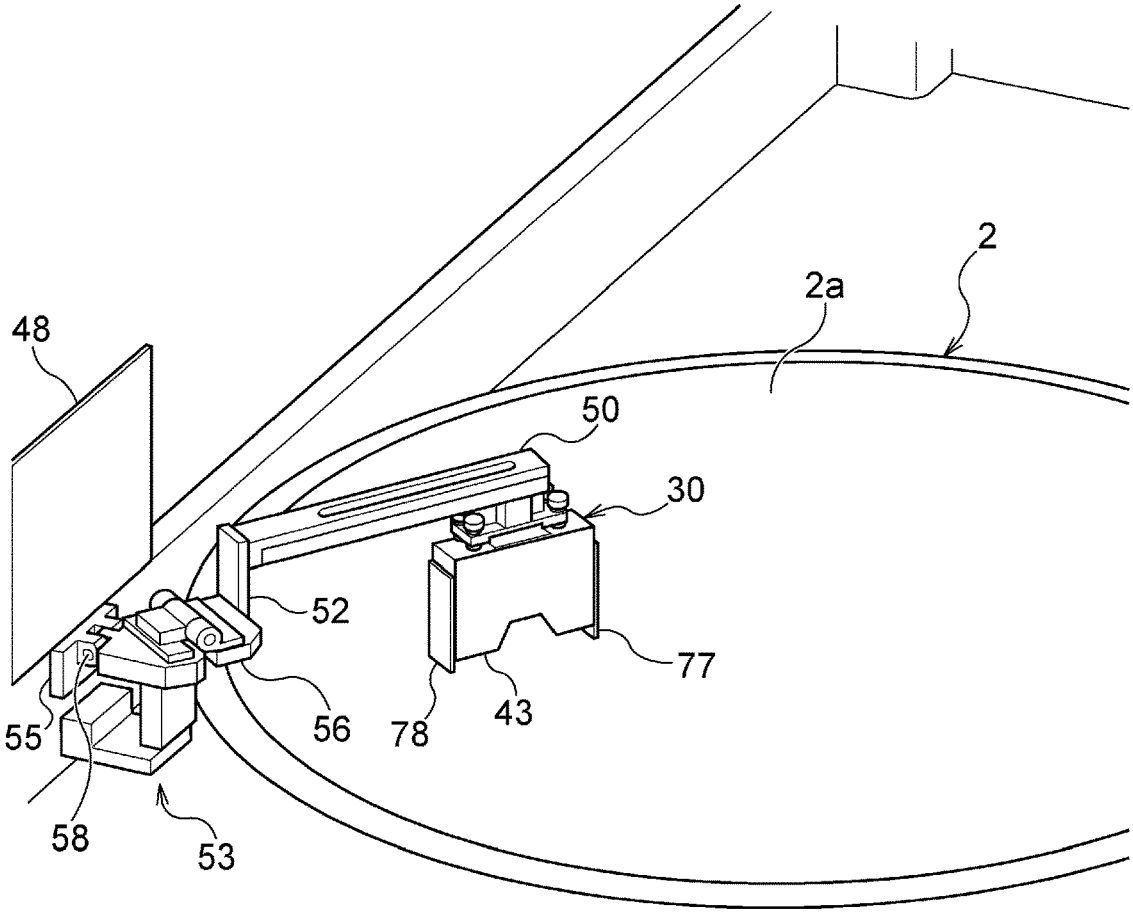
FIG. 6 is a perspective view schematically showing an example of the surface-property measuring device located inside the polishing apparatus.
Figure 7A:
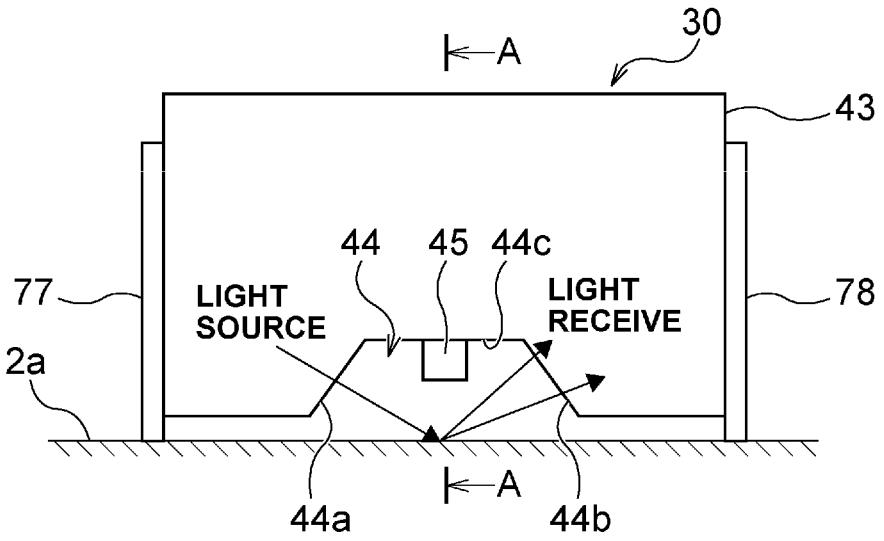
FIG. 7A is a front view of the surface-property measuring device shown in FIG. 6.
Figure 7B:
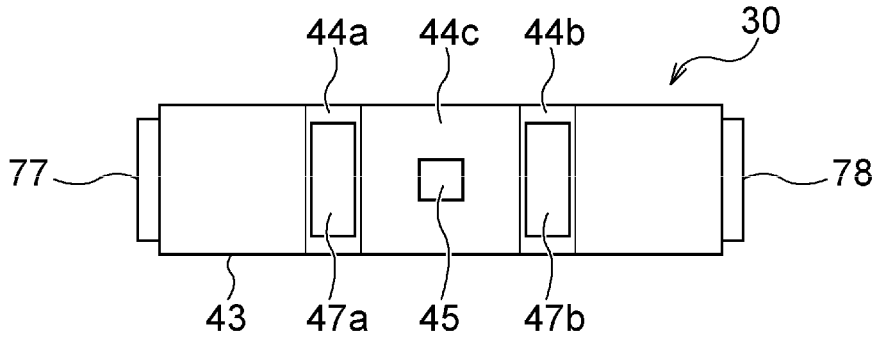
FIG. 7B is a bottom view of the surface-property measuring device shown in FIG. 7A.
Figure 8:
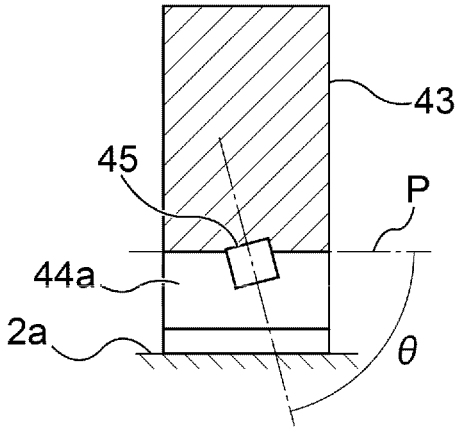
FIG. 8 is a cross-sectional view taken along line A-A of FIG. 7A.

The surface-property measuring device 30 configured as described above is located inside the polishing apparatus. FIG. 6 is a perspective view schematically showing an example of the surface-property measuring device 30 located inside the polishing apparatus. FIG. 7A is a front view of the surface-property measuring device 30 shown in FIG. 6, and FIG. 7B is a bottom view of the surface-property measuring device 30 shown in FIG. 7A. Further, FIG. 8 is a cross-sectional view taken along line A-A of FIG. 7A.

As shown in FIGS. 6 and 7A, the surface-property measuring device 30 has a casing 43. This casing 43 houses therein a measuring structure for measuring the surface properties of the polishing pad 2. The measuring structure housed in the casing 43 has, for example, the light source 31, light receiver 33, the polarizer 35, the ND filter 36, the mirror 37, the bandpass filter 38, the imaging device 39 and the like, which are described with reference to FIGS. 3 through 5.

As shown in FIG. 7A, a cutout 44 is formed in a bottom of the casing 43. In the present embodiment, the cutout 44 has a trapezoidal shape which is defined by two facing inclined surfaces 44*a*, 44*b* and a connecting surface 44*c* connecting these inclined surfaces 44*a*, 44*b*. As shown in FIG. 7B, one inclined surface 44*a* has a translucent filter 47*a* disposed therein, and a laser beam emitted from the light source 31 is applied through the filter 47*a* onto the polishing pad 2. The other inclined surface 44*b* also has a translucent filter 47*b* disposed therein, and the light receiver 33 receives the light reflected by the polishing pad 2 through the filter 47*b*. Examples of these filters 47*a*, 47*b* includes a transparent film or a transparent glass, for example. In the present embodiment, the connecting surface 44*c* extends linearly from one inclined surface 44*a* to the other inclined surface 44*b*.

The surface-property measuring device 30 has positioning plates 77, 78 which are fixed to the side surfaces of the casing 43, respectively. When the surface-property measuring device 30 is moved to a measure position (which will be described later) shown in FIGS. 6 and 7A, the positioning plates 77, 78 are brought into contact to the polishing surface 2*a* of the polishing pad 2. The positioning plates 77, 78 allow a distance from the polishing surface 2*a* of the polishing pad 2 to the measuring structure of the surface-property measurement device 30 in the vertical direction, and an angle of the surface-property measuring device 30 with respect to the polishing surface 2*a*, to be kept constant at all times.

As shown in FIGS. 7A, 7B, and 8, the surface-property measuring device 30 may have a nozzle 45 whose tip protrudes from the connecting surface 44*c*. The nozzle 45 of the surface-property measuring device 30 is coupled to a pressurized-gas supply line (not shown), and is configured to blow a pressurized gas (e.g., pressurized nitrogen or pressurized air) from the pressurized-gas supply line to the polishing surface 2*a* of the polishing pad 2. The pressurized gas blown from the nozzle 45 causes liquid, such as the polishing liquid, and the dressing liquid, on the polishing pad 2*a* to be removed. Therefore, the surface-property measuring device 30 can measure accurate surface properties of the polishing pad 2.

The nozzle 45 has an any shape. For example, the nozzle 45 may be a cylindrical nozzle whose diameter of flow path is same from a tip to an end thereof, or a Laval nozzle having a throat portion whose diameter of the flow path is gradually reduced, and an enlarged portion whose diameter of flow path is gradually enlarged, the enlarged portion being disposed downward of the throat portion.

As shown in FIG. 8, the nozzle 45 is arranged to be inclined with respect to a polishing surface 2*a* of the polishing pad 2, and the pressurized gas ejected from the nozzle 45 obliquely collides with the polishing surface 2*a* of the polishing pad 2. The nozzle 45 is disposed at an inclined angle θ with respect to a plane P parallel to the polishing surface 2*a* of the polishing pad 2, so that the pressurized gas flows toward an opening of the cutout 44 formed in the casing 43. Such configuration prevents liquid removed by the pressurized gas which is ejected from the nozzle 45 from being attaching to the filters 47*a*, 47*b* which are disposed in the inclined surfaces 44*a*, 44*b* of the cutout 44, respectively.

In this manner, the purpose of ejecting the pressurized gas from the inclined nozzle 45 is to remove liquid, such as polishing liquid or dressing liquid, on the polishing surface 2*a*, while preventing the liquid removed by the pressurized gas from splashing around and attaching to filters 47*a*, 47*b*, and the like. Therefore, the inclined angle θ is set to an optimum inclined angle for achieving the above purpose. The optimum inclined angle is, for example, set based on a pressure and a flow rate of the pressurized gas. The optimum inclined angle may be determined based on experiments performed while varying the pressure and/or the flow rate of the pressurized gas. This optimum inclined angle is, for example, 60°. In one embodiment, the nozzle 45 may be pivotally mounted to the casing 43. In this case, the inclined angle θ can be changed to the optimum inclined angle depending on the pressure and/or the flow rate of the pressurized gas.

Figure 9:
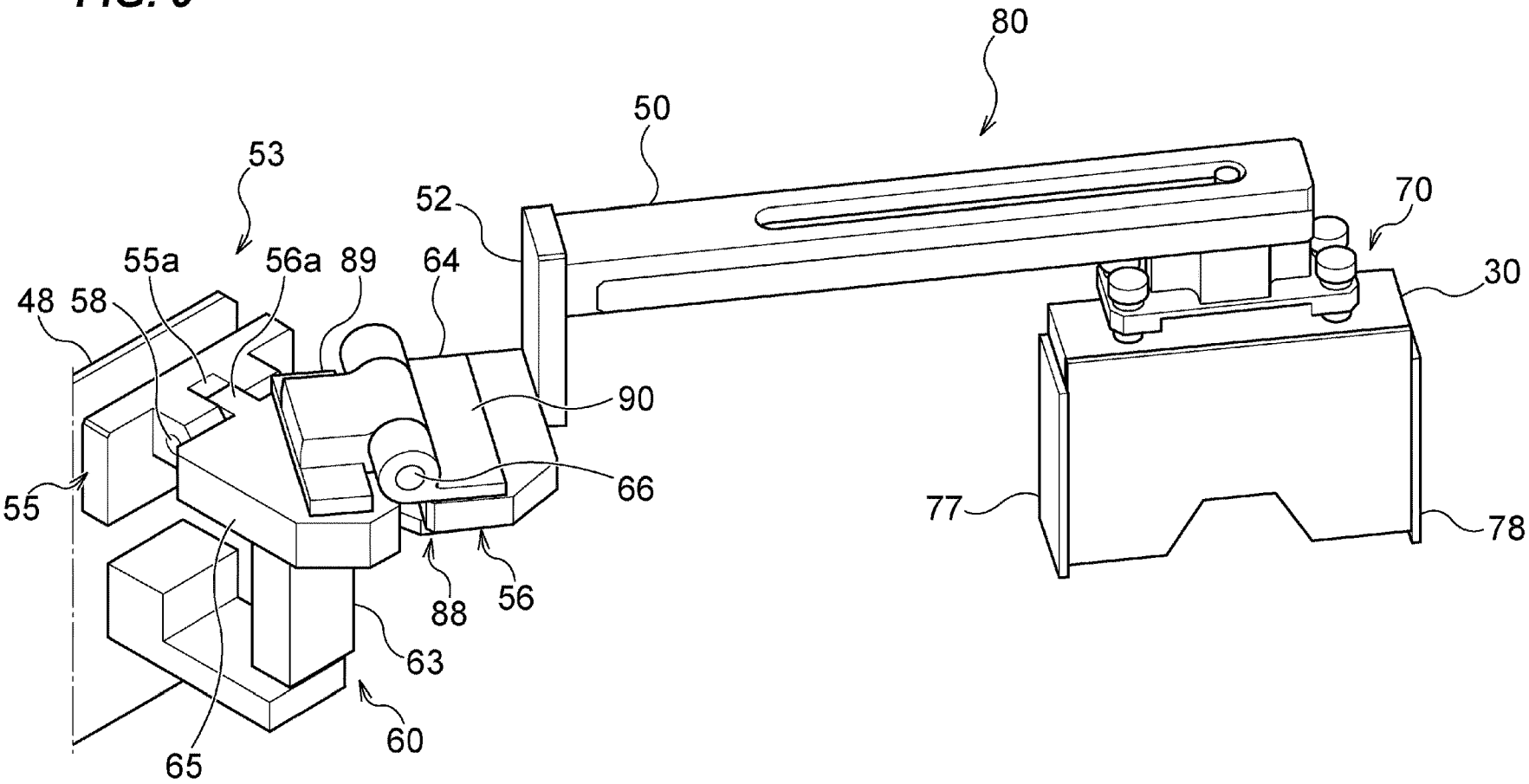
FIG. 9 is an enlarged schematic view showing a portion around the surface-property measuring device shown in FIG. 6.

FIG. 9 is an enlarged schematic view showing a portion around the surface-property measuring device 30 shown in FIG. 6. As shown in FIGS. 6 and 9, the surface-property measuring device 30 for measuring the surface properties of the polishing pad 2 is supported by a support arm 50, and this support arm 50 is coupled to a moving unit 53 fixed to the polishing apparatus. The moving unit 53 serves as a unit for moving the surface-property measuring device 30 from a retreat position to a measure position, or from the measure position to the retreat position. Specifically, the moving unit 53 allows a position of the surface-property measuring device 30 to be automatically changed from the retreat position to the measure position, or from the measure position to the retreat position.

In the present embodiment, the measure position of the surface-property measuring device 30 is defined as a position where the surface-property measuring device 30 is contacted to the polishing pad 2 for measuring the surface properties of the polishing pad 2. For example, the measure position of the surface-property measuring device 30 is a position at which the positioning plates 77, 78 are brought into contact with the polishing surface 2*a* of the polishing pad 2 as shown in FIG. 7A. Further, the retreat position of the surface-property measuring device 30 is defined as a position where the surface-property measuring device 30 is separated from the polishing pad 2.

As shown in FIG. 9, the moving unit 53 is constructed of a fixed block 55 fixed to the polishing apparatus, a pivot block 56 coupled to the support arm 50, a rotational shaft 58 for pivotably coupling the pivot block 56 to the fixed block 55, and a pivot mechanism 60 for pivoting the pivot block 56 around the center axis of the rotation axis 58. The fixed block 55 is fixed to a frame 48 of the polishing apparatus by fixtures (not shown), such as screws. The support arm 50 for supporting the surface-property measuring device 30 is connected to a support plate 52, which is fixed to the pivot block 56, by fixtures (not shown), and is coupled to the pivot block 56 via the support plate 52. In one embodiment, the support plate 52 and the pivot block 56 may be formed integrally. Further, the support arm 50 may be directly connected to the pivot block 56. In this case, the support plate 52 is omitted from the moving unit 53.

The pivot block 56 is coupled to the fixed block 55 via the rotational shaft 58. More specifically, the fixed block 56 has a recess 55*a* formed therein, and the pivot block 56 has a protrusion 56*a* formed therein, which is inserted into the recess 55*a* of the fixed block 55*a*. The protrusion 56*a* has a through-hole (not shown) formed therein, into which the rotational shaft 58 is inserted. The fixed block 55 has two through-holes (not shown) formed on each side of the recess 55*a* of the fixed block 55. When the protrusion 56*a* of the pivot block 56 is inserted into the recess 55*a* of the fixed block 55, the two through-holes formed in the fixed block 55 can be aligned with the through hole formed in the protrusion 56*a* of the pivot block 56. With the protrusion 56*a* of the pivot block 56 inserted into the recess 55*a* of the fixed block 55, the rotational shaft 58 is inserted into the two through-holes formed on each side of the recess 55*a* of the fixed block 55, and the through-hole formed in the protrusion 56*a*. This operation causes the pivot block 56 to be pivotably coupled to fixed block 55.

Figure 10:
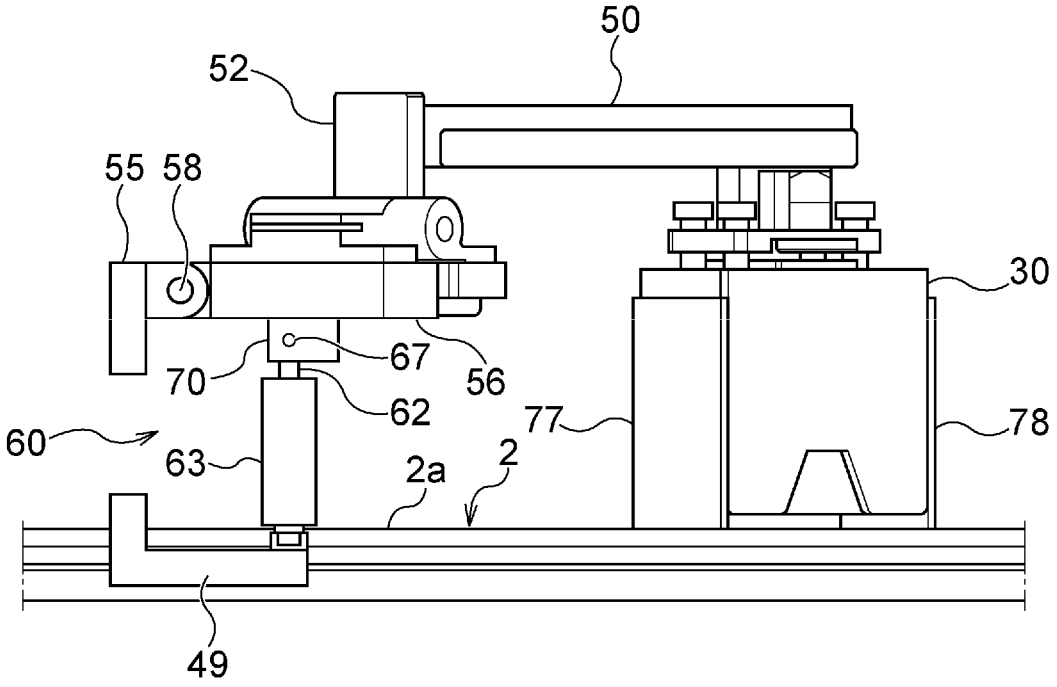
FIG. 10 is a view showing the surface-property measuring device moved to a measure position by a pivot mechanism shown in FIG. 9.
Figure 11:
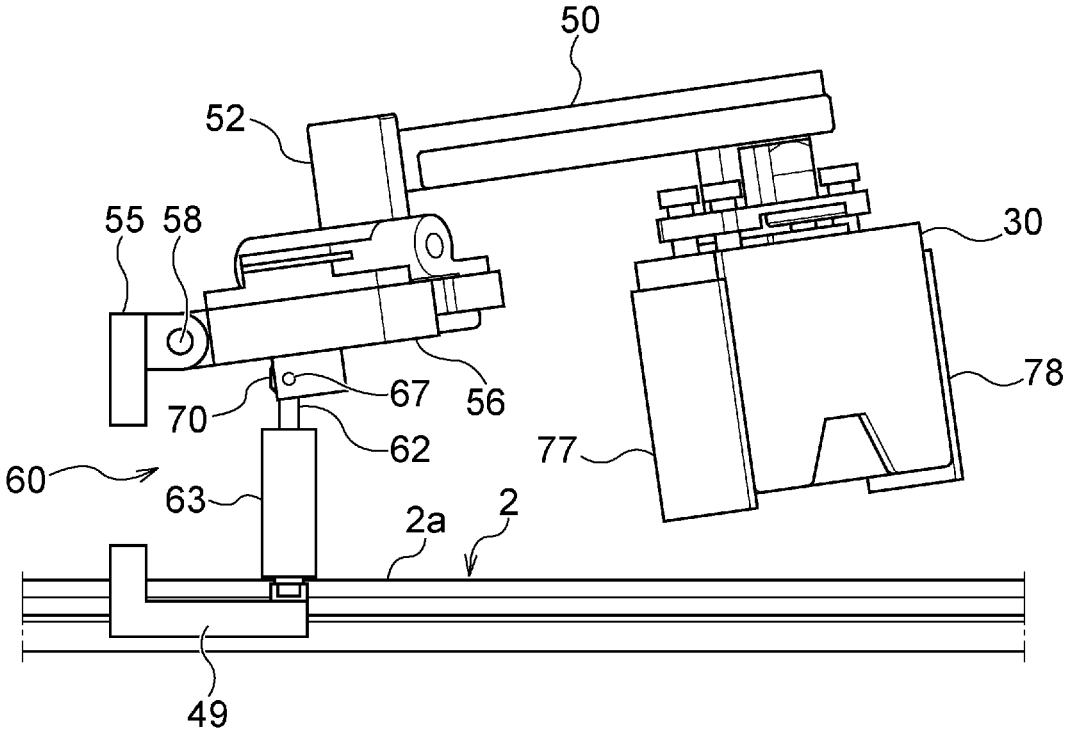
FIG. 11 is a view showing the surface-property measuring device moved to a retreat position by the pivot mechanism shown in FIG. 9.

FIG. 10 is a view showing the surface-property measuring device 30 moved to the measure position by the pivot mechanism 60 shown in FIG. 9, and FIG. 11 is a view showing the surface-property measuring device 30 moved to the retreat position by the pivot mechanism 60 shown in FIG. 9.

As shown in FIGS. 10 and 11, the pivot mechanism 60 according to the present embodiment is a piston-cylinder mechanism which is constructed of a piston 62 coupled to the pivot block 56, and a cylinder 63 in which the piston 62 is housed so as to be movable back and forth. A tip of the piston 62 is coupled to the pivot block 56 via a bracket 70, which is fixed to a lower surface of the pivot block 56. The tip of the piston 62 has a through-hole (not shown) formed therein, into which a pin 67 can be inserted, and the bracket 70 has through-holes 68 formed therein, into which the pin 72 inserted into the through-hole of the piston 62 can be inserted. With the through-hole formed in the tip of the piston 62 aligned with the through-holes 68 of the bracket, the pin 67 is inserted into the through-hole of the piston 62 and the through-holes 68 of the bracket, so that the piston 62 is coupled to the pivot block 56 via the bracket 70. The bracket 70 fixed to the lower surface of the pivot block 56 is pivotably coupled with respect to the piston 62.

The cylinder 63 is supported by a pedestal 49 extending from the frame 48 of the polishing apparatus. A fluid supply line (not shown) is coupled to the cylinder 63, and a fluid (e.g., pressurized nitrogen or pressurized air) is supplied to the cylinder 63 via the fluid supply line. The controller 23 (see FIG. 1) controls the supply of fluid to the cylinder 63 to move the piston 62 up and down. For example, an open/close valve (not shown) is arranged in the fluid supply line, and the controller 23 controls operation of this open/close valve to move the piston 62 up and down. More specifically, when raising the piston 62, the controller 23 opens the open/close valve to supply the fluid to the cylinder 63. When lowering the piston 62, the controller 23 closes the open/close valve to stop the supply of the fluid to the cylinder 63.

When measuring the surface properties of the polishing pad 2, the controller 23 causes the piston 62 of the pivot mechanism 60 to be lowered. This operation causes the pivot block 56 and the support arm 50 to be pivoted in a direction of moving the surface-property measuring device 30 downward, and the positioning plates 77, 78 are brought into contact with the polishing pad 2. Thus, the controller 23 can operate the pivot mechanism 60 to thereby move the surface-property measuring device 30 to the measure position shown in FIG. 10. In this state, the measurement of the surface properties of the polishing pad 2 described above is performed to determine the dressing conditions. When the controller 23 detects the abnormality of the polishing pad 2 from measured data for the surface properties obtained by the surface-property measuring device 30, the controller 30 may issue an alarm, and stop operations of the polishing apparatus.

After the measurement of the surface properties of the polishing pad 2 is completed, and the dressing conditions are determined, the controller 23 causes the piston 62 of the pivot mechanism 60 to be raised. This operation causes the pivot block 56 and the support arm 50 to be pivoted in a direction of moving the surface-property measuring device 30 upward, so that the surface-property measuring device 30 is separated from the polishing pad (see FIG. 11). Thus, the controller 23 operates the pivot mechanism 60 to thereby move the surface-property measuring device 30 from the measure position shown in FIG. 10 to the retreat position shown in FIG. 11. When measuring the surface properties of the polishing pad 2 again, the controller 23 operates the pivot mechanism 60 to thereby move the surface-property measuring device 30 from the retreat position shown in FIG. 11 to the measure position shown in FIG. 10.

Figure 12:
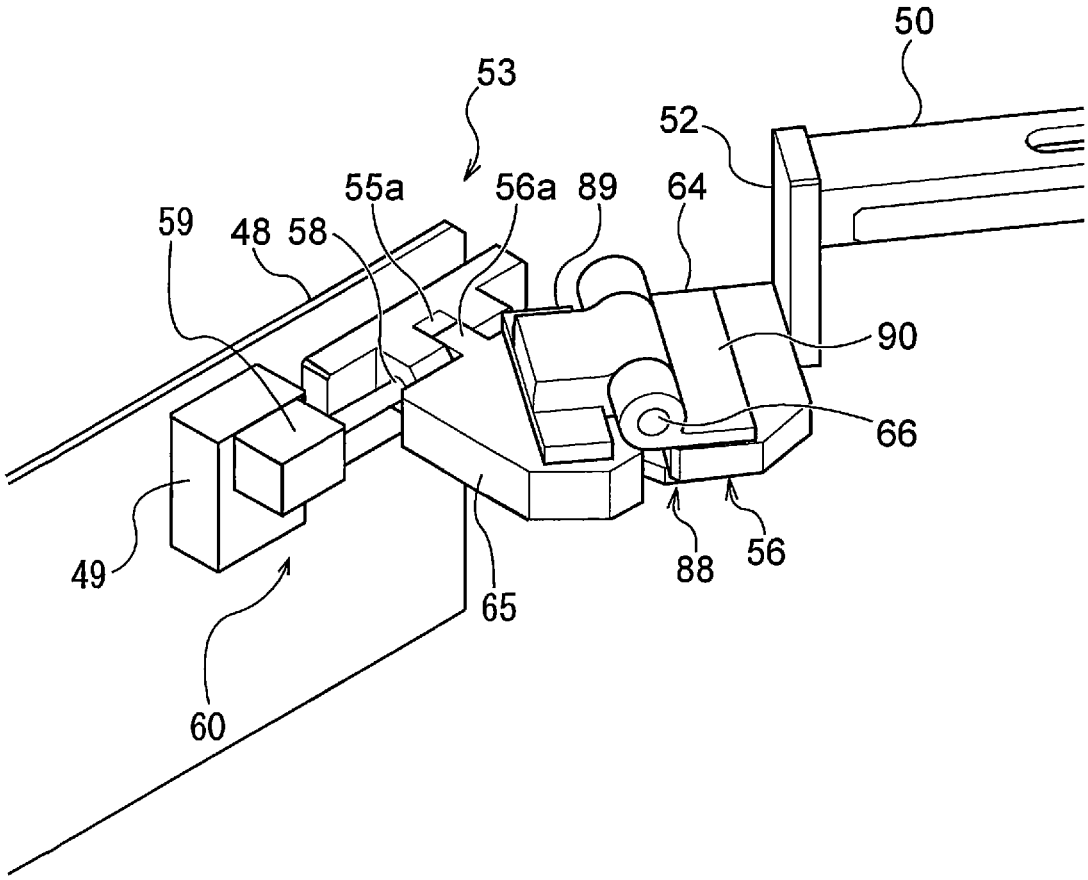
FIG. 12 is a schematic view showing another example of the pivot mechanism.

FIG. 12 is a schematic view showing another example of the pivot mechanism. The pivot mechanism 60 shown in FIG. 12 has a motor 59 coupled to the rotational shaft 58, and this motor 59 is electrically connected to the controller 23. The motor 59 is supported by the pedestal 49 extending from the frame 48 pf the polishing apparatus. In the present embodiment, the rotational shaft 58 is fixed to the pivot block 56. For example, the rotational shaft 58 has a key (not shown), and the protrusion 56*a* of the pivot block 56 has a key groove formed therein, which is engaged with the key. The key of the rotational shaft 58 is inserted into the key groove of the pivot block 56, thereby fixing the rotational shaft 58 to the pivot block 56 by the engagement of the key and the key groove.

The controller 23 controls operation of the motor 59 to rotate the rotational shaft 58, thereby rotating the pivot block 56 with respect to the fixed block 55. The pivot block 56 is coupled to the support arm 50 and the surface-property measuring device 30 via the support plate 52, so that operations of the motor 59 enables the surface-property measuring device 30 to be moved from the retreat position (see FIG. 11) to the measure position (see FIG. 10) or vice versa.

As shown in FIG. 9, the pivot block 56 may be constructed of a first plate 64 coupled to the support arm 50 via the support plate 52, and a second plate 65 coupled to the fixed block 55 via the rotational shaft 58. The first plate 64 is pivotably coupled to the second plate 65 via a rotational pin 66. In the embodiment shown in FIG. 9, the first plate 64 is coupled to the second plate 65 by a hinge mechanism 88 including the rotational pin 66. The hinge mechanism 88 is constructed of a first joint 89 fixed to an upper surface of the first plate 64, a second joint 90 fixed to an upper surface of the second plate 65, and the rotational pin 66 which pivotably couples the first joint 89 to the second joint 90.

Figure 13:
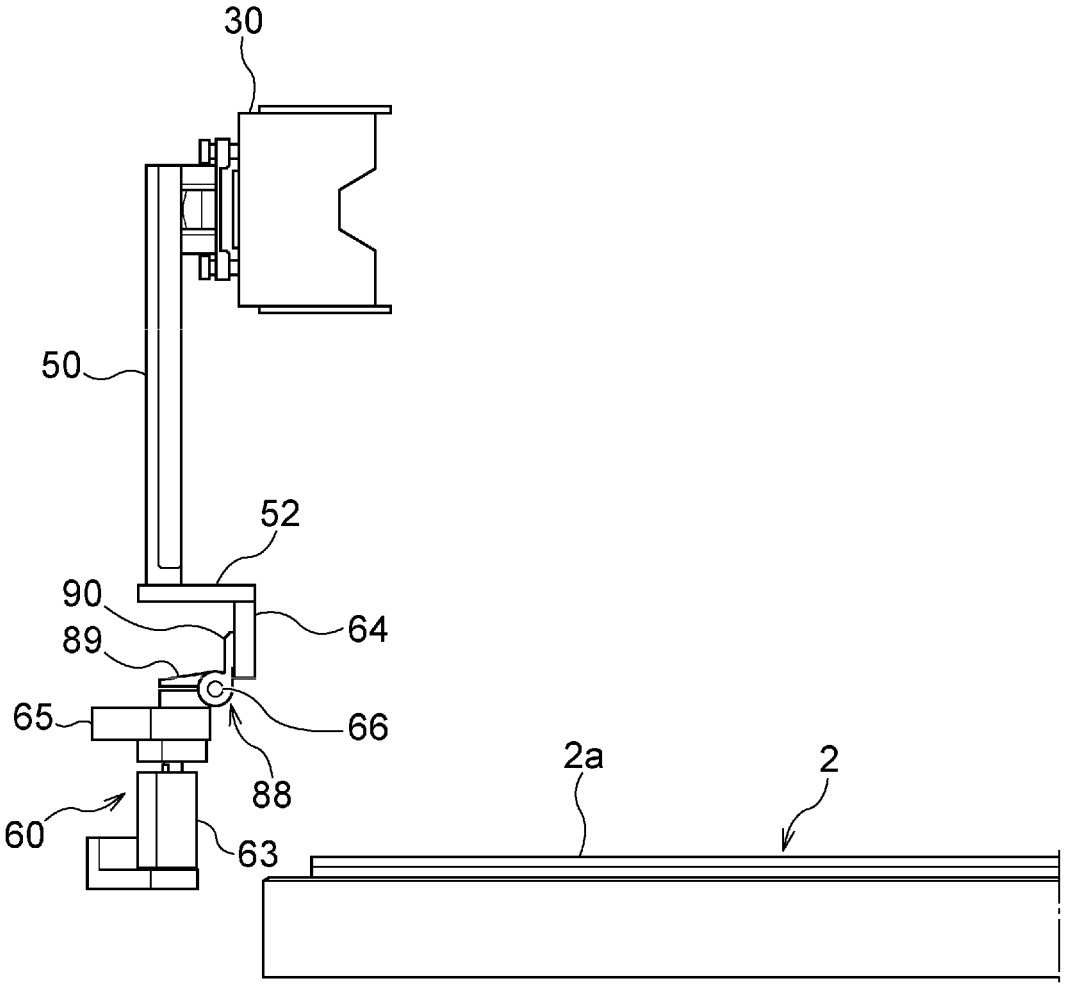
FIG. 13 is a schematic view showing the surface-property measuring device moved to a maintenance position.

FIG. 13 is a schematic view showing the surface-property measuring device 30 moved to a maintenance position. The maintenance position is a position in which the surface-property measuring device 30 is moved far away from the polishing pad 2 for performing maintenance or replacement of the polishing pad 2. In the embodiment shown in FIG. 13, the hinge mechanism 88 is operated so that the support arm 50 extends in the vertical direction. This operation causes the surface-property measuring device 30 to be positioned far away from the polishing pad 2, so that maintenance or replacement of the polishing pad 2 can be performed easily.

Although not shown, the polishing apparatus preferably has a fixture for preventing movement of the support arm 50 after the surface-property measuring device 30 is moved to the maintenance position. The fixture prevents the support arm 50 moved to the maintenance position from being unintentionally fallen over. Examples of fixture include a hook or a cramp which can be engaged with the support arm 50 moved to the maintenance position.

According to the present embodiment, the controller 23 can control the operation of the pivot mechanism 60 in the moving unit 53 to thereby move the surface-property measuring device 30 from the retreat position to the measure position, and further obtain automatically the surface properties of the polishing pad 2 by use of the surface-property measuring device 30. The controller 23 can determine the dressing conditions based on the surface properties obtained. The controller 23 may issue an alarm based on the surface properties obtained. In this manner, the attaching and detaching operations of the surface-property measuring device 30, which is conventionally required, is not necessary, and thus throughput of the polishing apparatus can be increased, and together burden of operators can be reduced.

The polishing apparatus may has an attitude adjustment mechanism for automatically adjusting attitude of the surface-property measuring device 30 such that a lower surface of the surface-property measuring device 30 becomes to be parallel to the surface of the polishing pad 2, when the surface-property measuring device 30 is moved to the measure position.

Figure 14A:
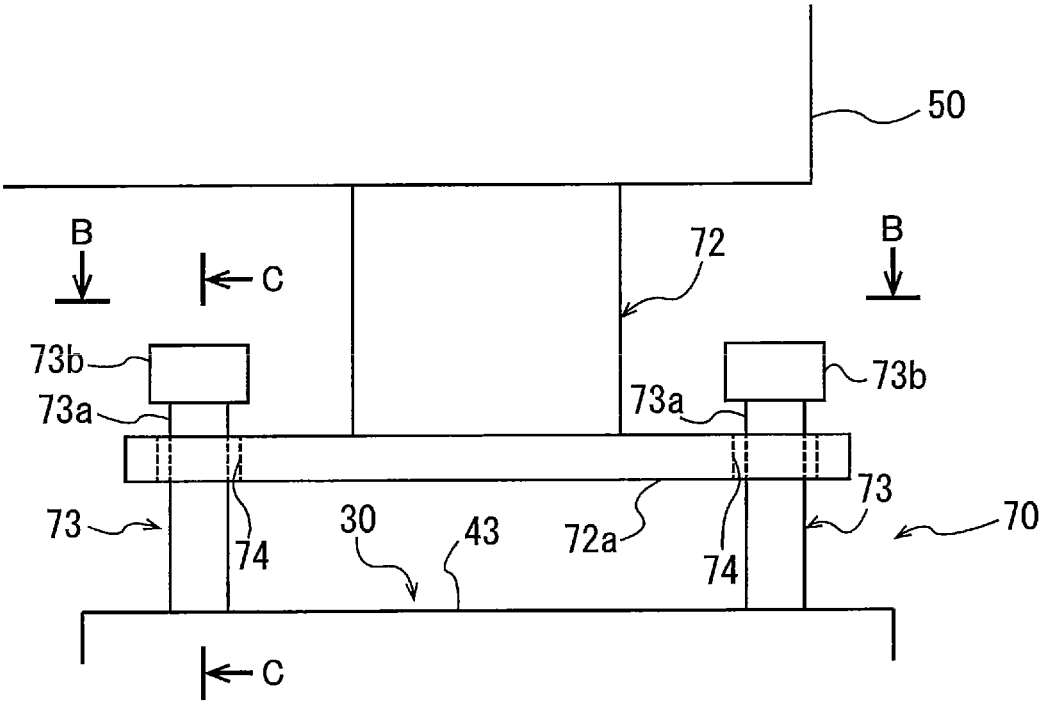
FIG. 14A is a schematic front view of an attitude adjustment mechanism according to an embodiment.
Figure 14B:
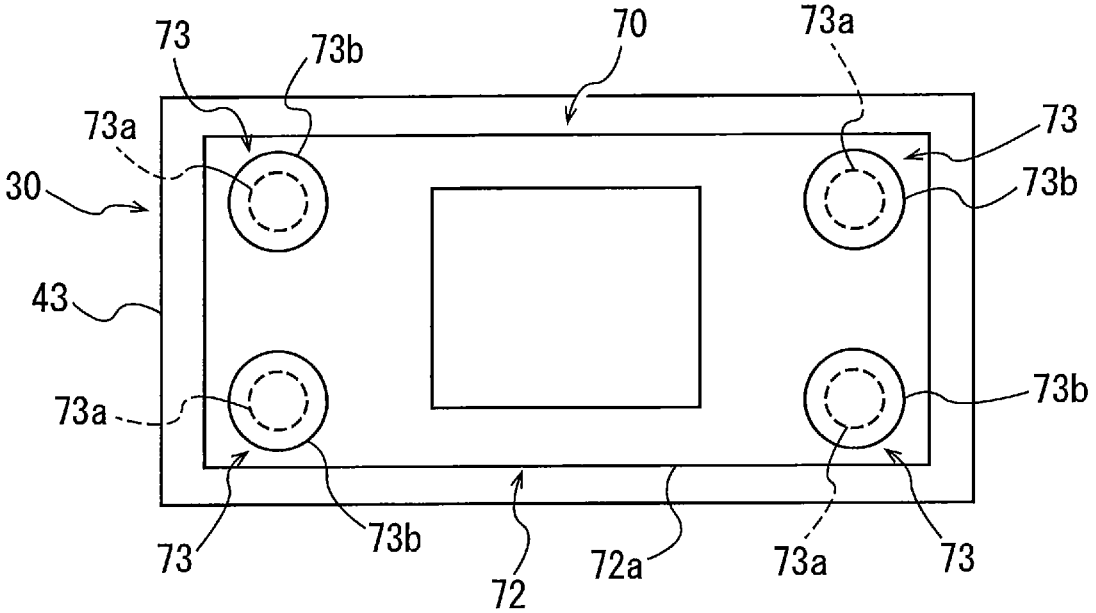
FIG. 14B is a view as viewed from line B-B of FIG. 14A.
Figure 15A:
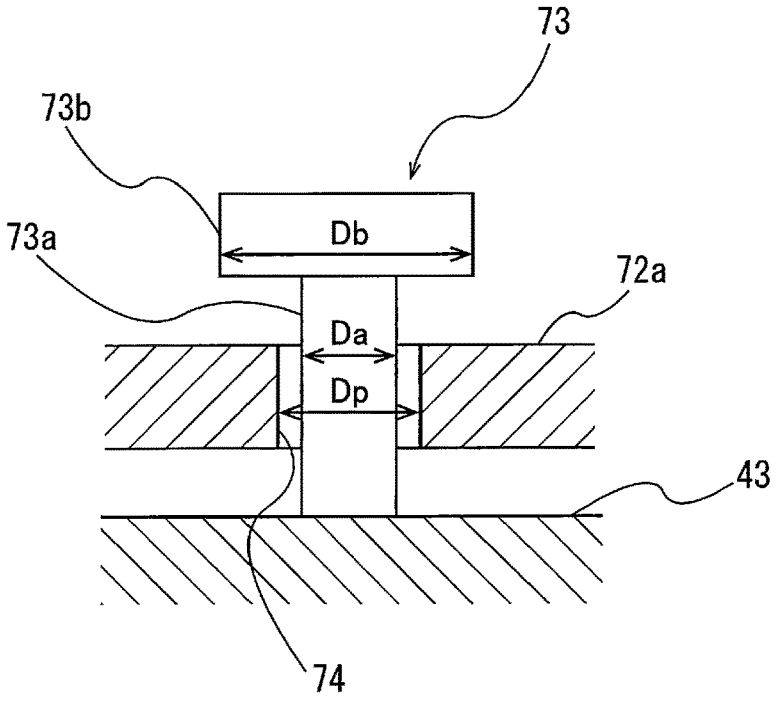
FIG. 15A is a cross-sectional view taken along line C-C of FIG. 14A.

FIG. 14A is a schematic front view of the attitude adjustment mechanism according to an embodiment, and FIG. 14B is a view as viewed from line B-B of FIG. 14A. FIG. 15A is a cross-sectional view taken along line C-C of FIG. 14A, and FIG. 15B is a cross-sectional view of a portion of the attitude adjustment mechanism corresponding to FIG. 15A, when the surface-property measuring device 30 is moved to the retreat position.

As shown in FIGS. 14A and 14B, the attitude adjustment mechanism 70 has a support base 72 coupled to the support arm 50, and at least one adjustment pin 73 which is fixed to an upper surface of the surface-property measuring device 30, and extends through a through-hole formed in the support base 72. In the present embodiment, four adjustment pins 73 are fixed to the upper surface of the surface-property measuring device 30. The support base 72 is directly fixed to the lower surface of the support arm 50. Further, the support base 72 has a flange portion 72*a* at a bottom part thereof, and four through-holes 74 are formed at four corners of the flange portion 72*a*, respectively. Each adjustment pin 73 extends through each through-hole 74 formed in the flange portion 72*a*.

As shown in FIG. 15A, the adjustment pin 73 has a pin body 73*a* having a diameter Da smaller than a diameter Dp of the through-hole74, and a pin head 73*b* formed at a top of the pin body 73*a*. The pin head 73*b* is located above the through-hole 74. More specifically, the pin head 73*b* is located between the support arm 50 and the flange portion 72*a* of the support base 72 (see FIG. 14A). The pin head 73*b* has a diameter Db larger than a diameter Dp of the through-hole 74.

Figure 15B:
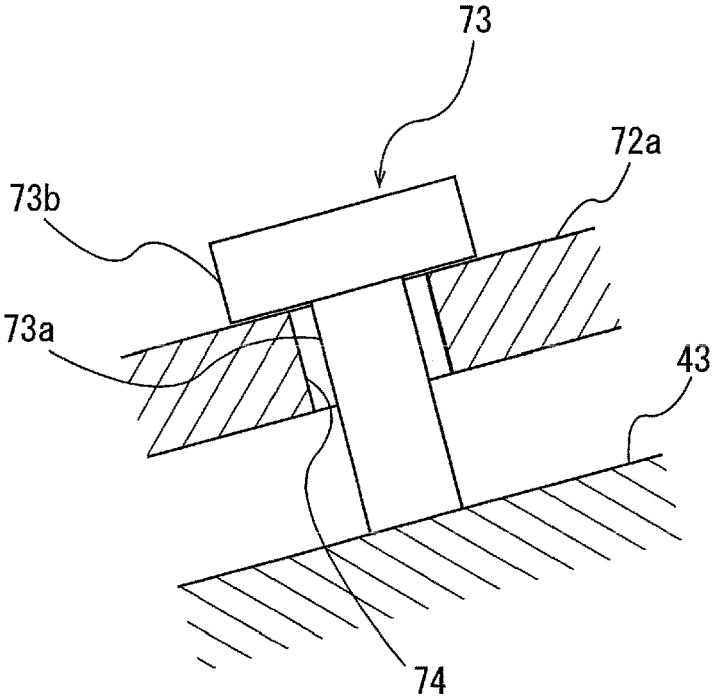
FIG. 15B is a cross-sectional view of a portion of the attitude adjustment mechanism corresponding to FIG. 15A, when the surface-property measuring device is moved to the retreat position.

As shown in FIG. 15B, when the controller causes the surface-property measuring device 30 to be moved to the retreat position, a lower surface of the pin head 73*b* is brought into contact with an upper surface of the flange portion 72*a* of the support base 72, so that the surface-property measuring device 30 is supported by the support arm 50 via the support base 72. When the controller 23 causes the surface-property measuring device 30 to be moved to the measure position to bring the positioning plates 77, 78 of the surface-property measuring device 30 into contact with the polishing surface 2*a* of the polishing pad 2, a lower surface of the pin head 73*b* is separated from the flange portion 72*a* of the support base 72. Thus, the surface-property measuring device 30 is supported on the polishing surface 2*a* of the polishing pad 2 by its own weight. Therefore, by the attitude adjustment mechanism 70, the attitude of the surface-property measuring device 30 is adjusted so as to become the lower surface thereof to be parallel to the polishing surface 2*a* of the polishing pad 2.

Further, as shown in FIG. 9, the polishing apparatus may have a displacement mechanism 80 for adjusting a position of the surface-property measuring device 30 in a horizontal direction, along the support arm 50. The displacement mechanism 80 serves as a mechanism for moving the position of the surface-property measuring device 30 in the horizontal direction, along a longitudinal direction of the support arm 50.

Figure 16:
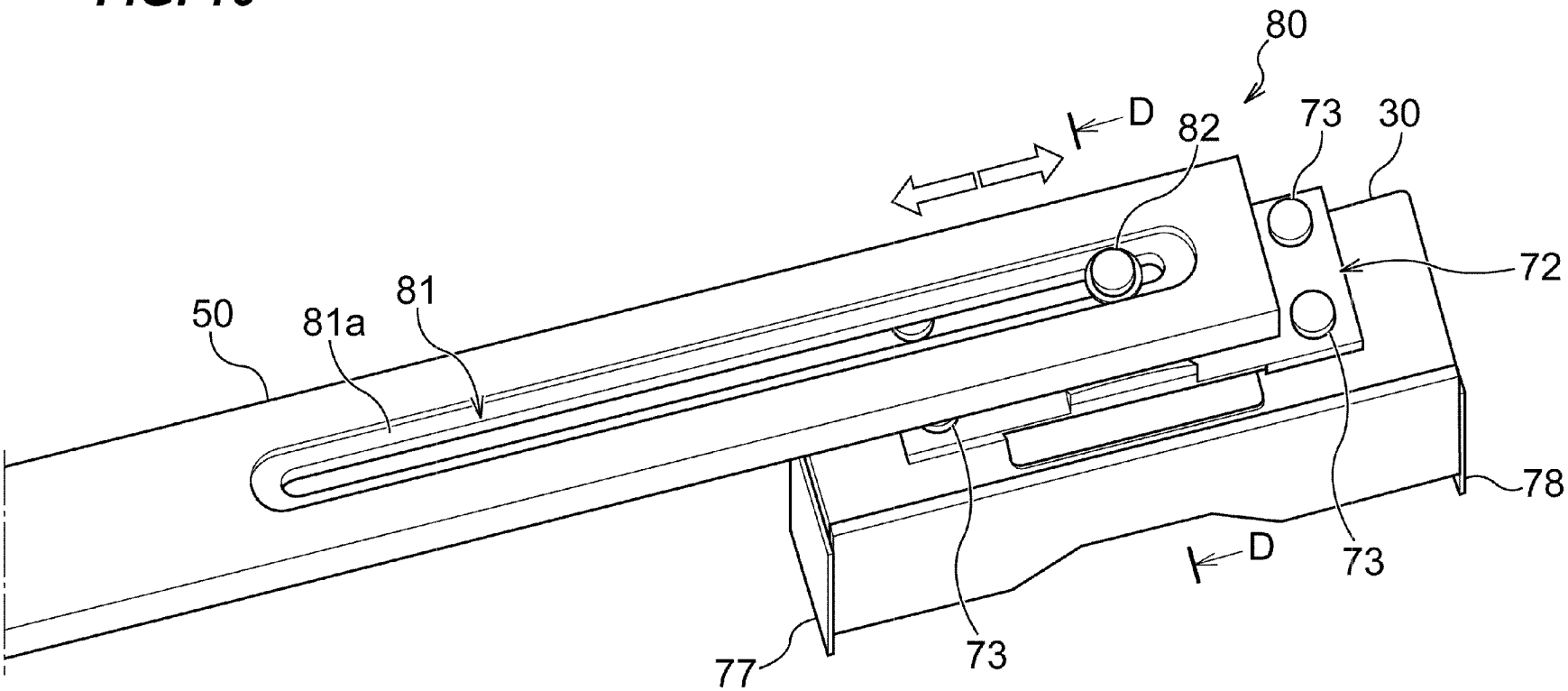
FIG. 16 is a perspective view schematically showing a displacement mechanism shown in FIG. 9.
Figure 17:
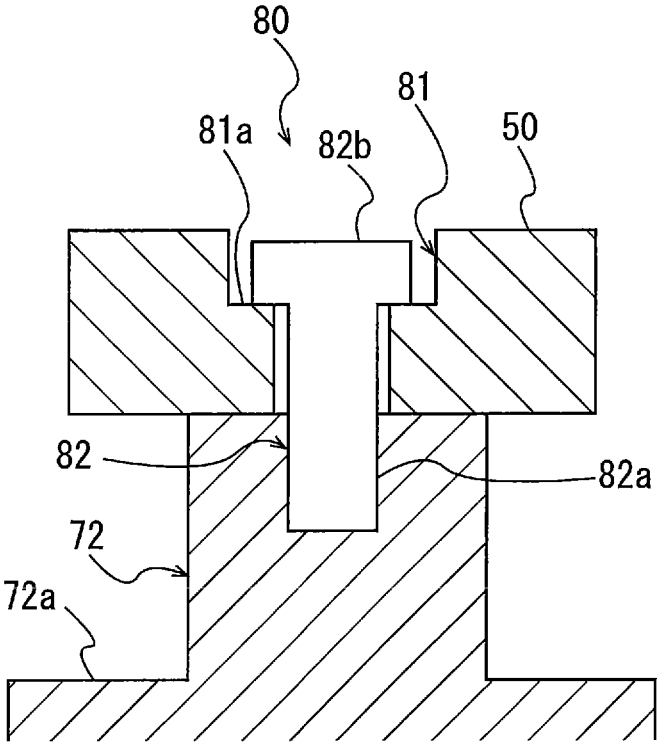
FIG. 17 is a cross-sectional view taken along line D-D of FIG. 16.

FIG. 16 is a perspective view schematically showing the displacement mechanism 80 shown in FIG. 9. FIG. 17 is a cross-sectional view taken along line D-D of FIG. 16. As shown in FIGS. 16 and 17, the displacement mechanism 80 has a slotted hole 81 extending along the longitudinal direction of the support arm 50, and support shaft 82 inserted into the slotted hole 81. The slotted hole 81 has a stepped portion 81*a* formed therein. The support shaft 82 has a shaft body 82*a* coupled to the surface-property measuring device 30, and a shaft head 82*b* which is in contact with the stepped portion 81*a* of the slotted hole 81. In the present embodiment, the support shaft 82 is a bolt which is screwed into a threaded hole (not shown) formed in an upper surface of the support base 72, and coupled to the surface-property measuring device 30 via the support base 72 and the attitude adjustment mechanism 70. Hereinafter, the support shaft 82 will occasionally be referred to as "the bolt 82", the shaft body 82*a* will occasionally be referred to as "bolt body 82*a*", and the shaft head 82*b* will occasionally be referred to as "bolt head 82*b*".

The bolt body 82*a* of the bolt 82 has a diameter smaller than a width of the stepped portion 81*a* in a direction perpendicular to the longitudinal direction of the slotted hole 81 and in the horizontal direction, and the bolt head 82*b* of the bolt 82 has a diameter larger than this width of the stepped portion 81*a* of the slotted hole 81. Further, the diameter of the bolt head 82*b* is smaller than a width of an upper portion of the long hole 81, where the stepped portion 81*a* is not formed. Therefore, when the bolt 82 is inserted into the slotted hole 81 from above the support arm 50, the bolt body 82*a* pass through the slotted hole 81 without contacting the stepped portion 81*a* of the slotted hole 81. On the other hand, the bolt head 82*b* is in contact with the stepped portion 81*a* of the slotted hole 81, and cannot pass through the stepped portion 81*a*.

When the surface-property measuring device 30 is to be supported on the support arm 50, the bolt 82 is inserted into the slotted hole 81 from above the support arm 50 in a state where the support base 72 is in contact with the lower surface of the support arm 50, and is screwed into the threaded hole formed in the support base 72. The bolt 82 is screwed into the threaded hole of the support base 72 until the bolt head 82*b* of the bolt 82 is brought into contact with the stepped portion 81*a*, thereby coupling the surface-property measuring device 30 to the support arm 50 via the support base 72. By further screwing the bolt 82 into the threaded hole of the support base 72, the support base 72 is firmly secured to the support arm 50, resulting in fixing the position of the support base 72 (i.e., the surface-property measuring device 30) in the horizontal direction.

When the position of the surface-property measuring device 30 in the horizontal direction is to be adjusted (i.e., changed), the bolt 82 is loosen to move the support base 72 (i.e., the surface-property measuring device 30) along the slotted hole 81 to a desired position. Then, the bolt 82 is screwed in the threaded hole of the support base 72 again to thereby fix the position of the surface-property measuring device 30 in the horizontal direction.

According to the present embodiment, the displacement mechanism 80 enables the position of the surface-property measuring device 30 in the horizontal direction to be adjusted, so that the surface-property measuring device 30 can measure the surface properties at any position (i.e., a desired position) of the polishing pad 2.

Figure 18:
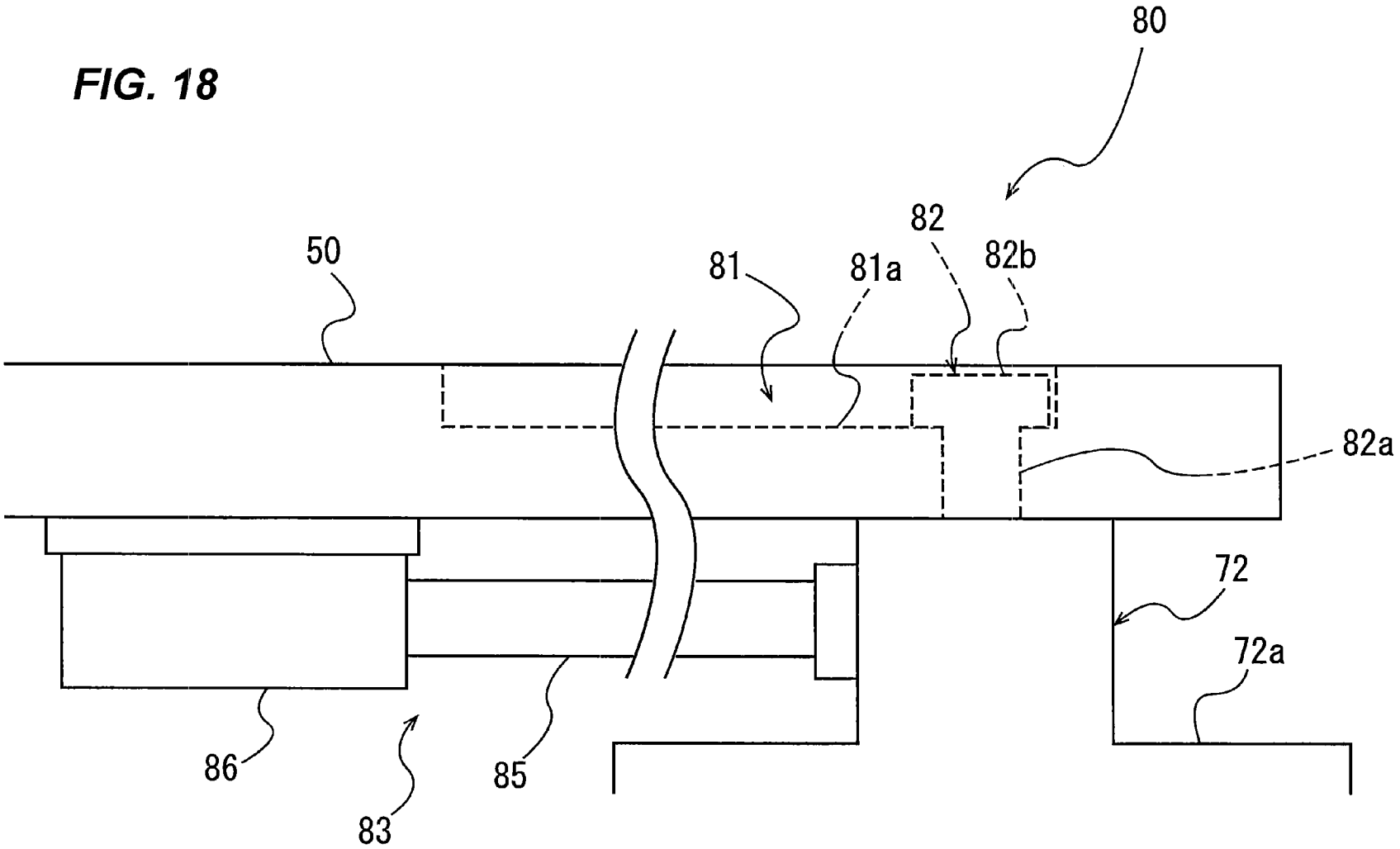
FIG. 18 is a schematic view showing another embodiment of the displacement mechanism.

FIG. 18 is a schematic view showing another embodiment of the displacement mechanism 80. The configuration of the present embodiment which will not be particularly described is the same as that of the displacement mechanism 80 shown in FIGS. 16 and 17, and thus a duplicate description thereof will be omitted.

In the displacement mechanism 80 shown in FIG. 18, the position of the support base 72 is not fixed to the support arm 50 by the support shaft (i.e., bolt) 82. More specifically, the shaft head 82*b* of the support shaft 82 is only in contact with the stepped portion 81*a*, and thus the slotted hole 81 serves as a guide hole for guiding the support base 72 (i.e., the surface-property measuring device 30) along the support arm 50. Further, the displacement mechanism 80 includes a piston-cylinder mechanism 83 which has a piston 85 coupled to the surface-property measuring device 30, and a cylinder 86 in which the piston 85 is housed so as to be movable back and forth. In the present embodiment, a tip of the piston 85 is connected to a side surface of the support base 72, and the cylinder 86 is fixed to the lower surface of the support arm 50. Further, the cylinder 86 is coupled to a fluid supply line (not shown).

A pressurized fluid (e.g., pressurized nitrogen or pressurized air) supplied from the fluid supply line to the cylinder 86 enables the piston 85 to move back and forth along the support arm 50. By moving the piston 85 back and forth along the support arm 50, the position of the surface-property measuring device 30, which is coupled to the piston 85 via the support base 72, in the horizontal direction can be adjusted. The controller 23 (see FIG. 1) controls the supply of the pressurized fluid supplied to the cylinder 86 to automatically change the position of the surface-property measuring device 30 in the horizontal direction. In this manner, the displacement mechanism 80 according to the present embodiment can adjust the position of the surface-property measuring device 30 in the horizontal direction automatically.

Although not shown, the displacement mechanism 80 may have, instead of the piston-cylinder mechanism, a ball-screw mechanism for changing the position of the surface-property measuring device 30 in the horizontal direction. In this case also, the controller 23 can control operation of the ball-screw mechanism to automatically adjust the position of the surface-property measuring device 30 in the horizontal direction.

The controller 23 may move the surface-property measuring device 30 to the measure position during polishing of the substrate W, or dressing of the polishing pad 2, to measure the surface-properties of the rotating polishing pad 2. As described above, the surface-property measuring device 30 has the filters 47*a*, 47*b* (see FIG. 7B), which are disposed in the inclined surfaces 44*a*, 44*b* of the casing 43, respectively. During polishing of the substrate W, or dressing of the polishing pad 2, the fluid, such as polishing liquid (i.e., slurry), or the dressing liquid, is supplied onto the polishing pad 2. However, the filters 47*a*, 47*b* prevent the liquid from entering in the casing 43. Thus, the filters 47*a*, 47*b* can prevent the fluid from contaminating the measuring structure, such as the light source 31 and the light receiver 33. Further, in the case in which the surface-property measuring device 30 has the nozzle 45 arranged to be inclined with respect to a polishing surface 2*a* of the polishing pad 2, the pressurized gas ejected from the nozzle 45 blows the fluid on the polishing surface 2*a* from the cutout 44 out of the surface-property measuring device30. As a result, even during polishing the substrate W or dressing, it is possible to more effectively prevent the fluid from adhering to the filters 47*a*, 47*b*, and it is possible to accurately measure the surface properties of the polishing pad 2.

Figure 19:
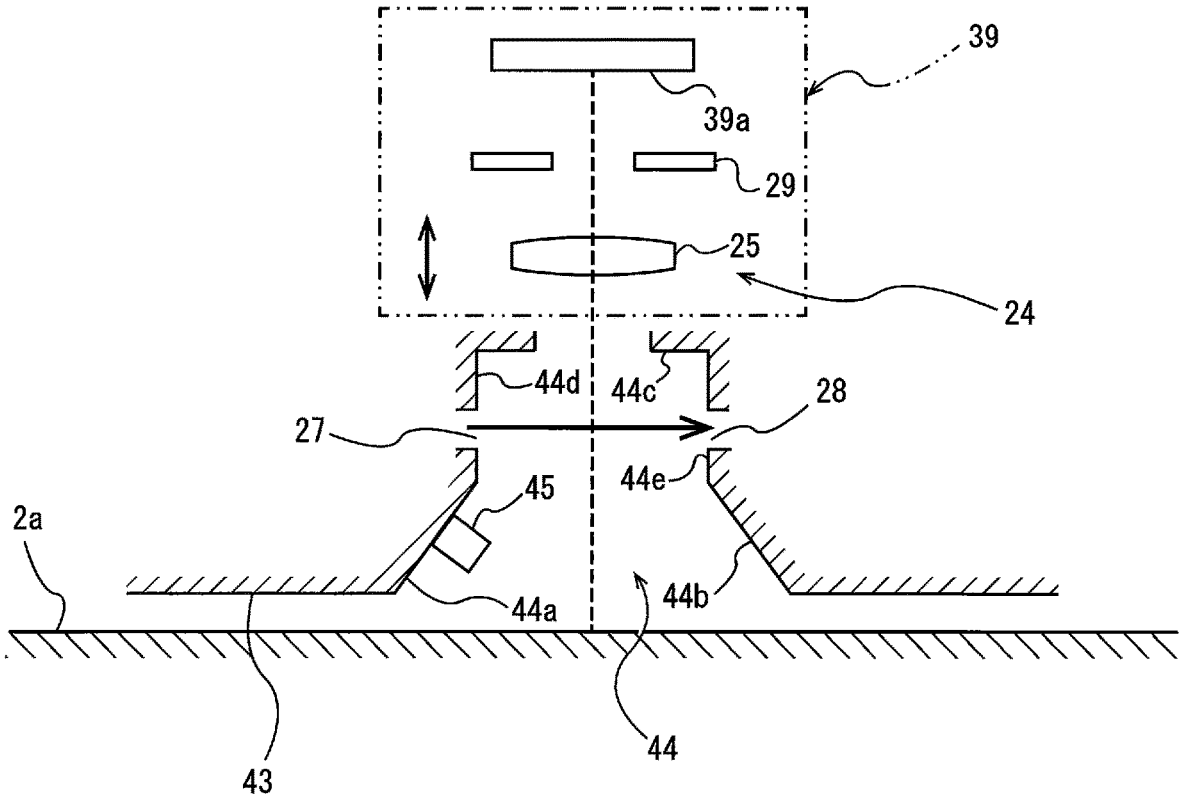
FIG. 19 is a schematic view showing an example of an internal structure (measuring structure) of an imaging device shown in FIG. 5.

FIG. 19 is a schematic view showing an example of an internal structure (measuring structure) of the imaging device 39 shown in FIG. 5. In FIG. 19, an portion of the casing 43 housing the imaging device 39 therein is also illustrated. The portion of the casing 43 shown in FIG. 19 illustrates a modified example of the cutout 44 formed in the bottom of the casing 43 in which the imaging device 30 is housed.

As described above, the imaging device 39 is housed in the casing 43 of the surface-property measuring device 30, and is configured to acquire the image information of the surface properties of the polishing pad 2. The imaging device 39 shown in FIG. 19 has an image sensor with an imaging area 39*a*, a lens mechanism 24 for forming the surface image of the polishing pad 2 on the imaging area 39*a*, and an aperture 29. The lens mechanism 24 includes a lens 25, and a focus mechanism (not shown) for moving the lens 25 between the surface of the polishing pad 2 and the imaging area 39*a*. The focus mechanism enables the lens 25 to be moved, thereby forming the surface image of the polishing pad 2 on the imaging area 39*a*.

In the present embodiment, the aperture 29 is arranged between the imaging area 39*a* and the lens 25. The aperture 29 is used to adjust a size of a field of view of the imaging device 39, and to remove noise from the background.

Although not shown, an aperture 29 may be provided in the surface-property measuring device 30 shown in FIGS. 3 and 4. In this case, the aperture 29 is arranged between the polishing surface 2*a* and the light receiver 33 on an optical path formed between the light emitter 32 and the light receiver 33. The aperture 29 is used to adjust a diffraction width (the order of diffracted light) of the laser beam reflected from the polishing pad 2, and to remove noise from the background.

In the present embodiment, the cutout 44 formed in the bottom of the casing 43 of the surface-property measuring device 30 has a shape which is defined by two facing inclined surfaces 44*a*, 44*b*, side surfaces 44*d*, 44*e* extending upward from each of inclined surface 44*a*, 44*b*, and a connecting surface 44*c* connecting these side surfaces 44*d*, 44*e*. In the example illustrated, the side surfaces 44*d*, 44*e* extend in the vertical direction. Hereinafter, the side surfaces 44*d*, 44*e*, are referred to as vertical surfaces 44*d*, 44*e*, respectively.

If liquid, such as the polishing liquid or the dressing liquid, is present on the polishing surface 2*a* of the polishing pad 2 to be captured by the imaging device 39, the imaging device 39 cannot acquire an accuracy image information of the surface properties of the polishing pad 2. Therefore, the pressurized gas is ejected from the nozzle 45 described above to thereby remove the liquid on the polishing surface 2*a* to be captured by the imaging device 39.

In the present embodiment, the nozzle 45 protrudes from one inclined surface 44*a*. One vertical surface 44*d* has an opening 27 formed therein, and the other vertical surface 44*e* has another opening 28 formed therein. The openings 27, 28 are located between the polishing surface 2*a* and the lens 25. The opening 27 is configured to eject gas (for, example CDA (clean dry air), dry air, or nitrogen gas) toward the opening 28, and the opening 28 is configured to allow the gas ejected from the opening 27 to flow into. Such configuration enables a curtain of gas flowing from the openings 27 towards the openings 28 to be formed. The curtain of gas formed between the openings 27, 28 prevents the liquid, which is splashed by the pressurized gas ejected from the nozzle 45, from reaching to the lens 25. Therefore, the imaging device 39 can acquire the accurate image information of the polishing surface 2*a* of the polishing pad 2.

In the example shown in FIG. 19, the opening 27 is located on a vertical plane being parallel to a plane of paper of FIG. 19 and passing through the nozzle 45. The gas from the opening 27 and the pressurized gas from the nozzle 45 are ejected in a direction parallel to the plane of paper of FIG. 19. However, the opening 27 may be shifted from the vertical plane, which is parallel to the plane of paper of FIG. 19 and passes through the nozzle 45, in the horizontal direction. Further, the gas from the opening 27 and the pressurized gas from the nozzle 45 may be ejected in a direction different from the direction parallel to the plane of paper of FIG. 19.

Although not shown, a portion (for example, lower portion) of the inclined surface 44*b* facing to the nozzle 45 may be formed in a curved shape. A surface of the portion of the inclined surface 44*b* formed in a curved shape serves as a guide surface for smoothly discharging the liquid splashed from the polishing surface 2*a* by the pressurized gas ejected from the nozzle 45, out of the casing 43 of the surface-property measuring device 30. Alternatively, the inclined surface 44*b* facing to the nozzle 45 may have, in the lower portion thereof, a cutout for facilitating the discharge of the liquid out of the casing 43.

Figure 20:
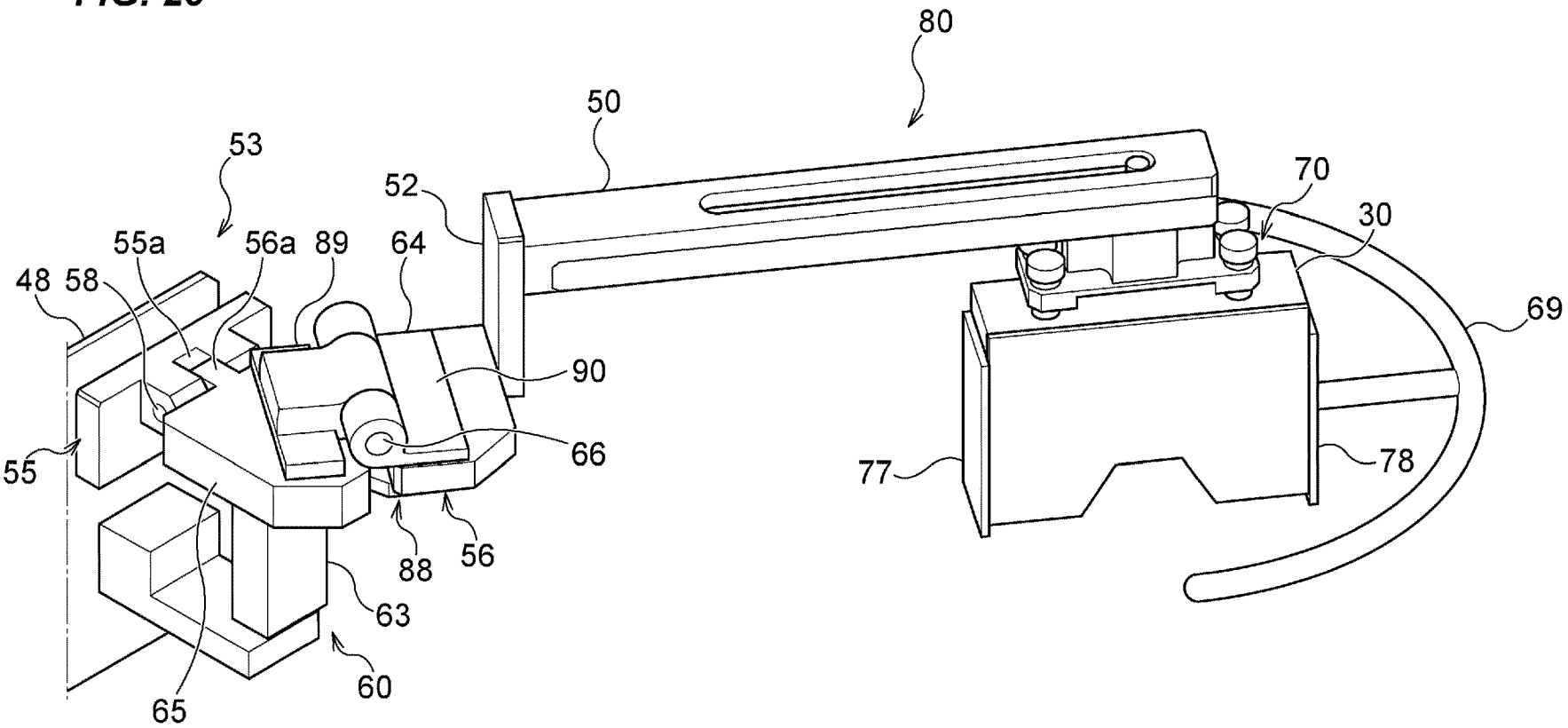
FIG. 20 is a schematic view showing another embodiment of the surface-property measuring device.

FIG. 20 is a schematic view showing another embodiment of the surface-property measuring device 30. The configuration of the present embodiment which will not be particularly described is the same as that of the surface-property measuring device 30 according to the embodiments described above, and thus a duplicate description thereof will be omitted.

As shown in FIG. 20, the surface-property measuring device 30 has a barrier 69 coupled to a side surface of the casing 43. In the present embodiment, the barrier 69 is mounted to a side surface of the positioning plate 78. A lower surface of the barrier 69 is brought into contact with the polishing surface 2*a* of the polishing pad 2 when the surface-property measuring device 30 is moved to the measure position (see FIG. 10). The barrier 69 serves as a fence for preventing the fluid, such as the polishing liquid or the dressing liquid, supplied onto the polishing surface 2*a* of the polishing pad 2 from reaching to the surface-property measuring device 30. The barrier 69 according to the present embodiment has an arc shape. The barrier 69 guides the fluid, flowing on the polishing surface 2*a* towards the surface-property measurement device 30, along the arc shape of the barrier 69, thereby preventing the fluid from reaching to the surface-property measurement device 30. Although not shown, the barrier 69 may be mounted to the support arm 50.

Figure 21:
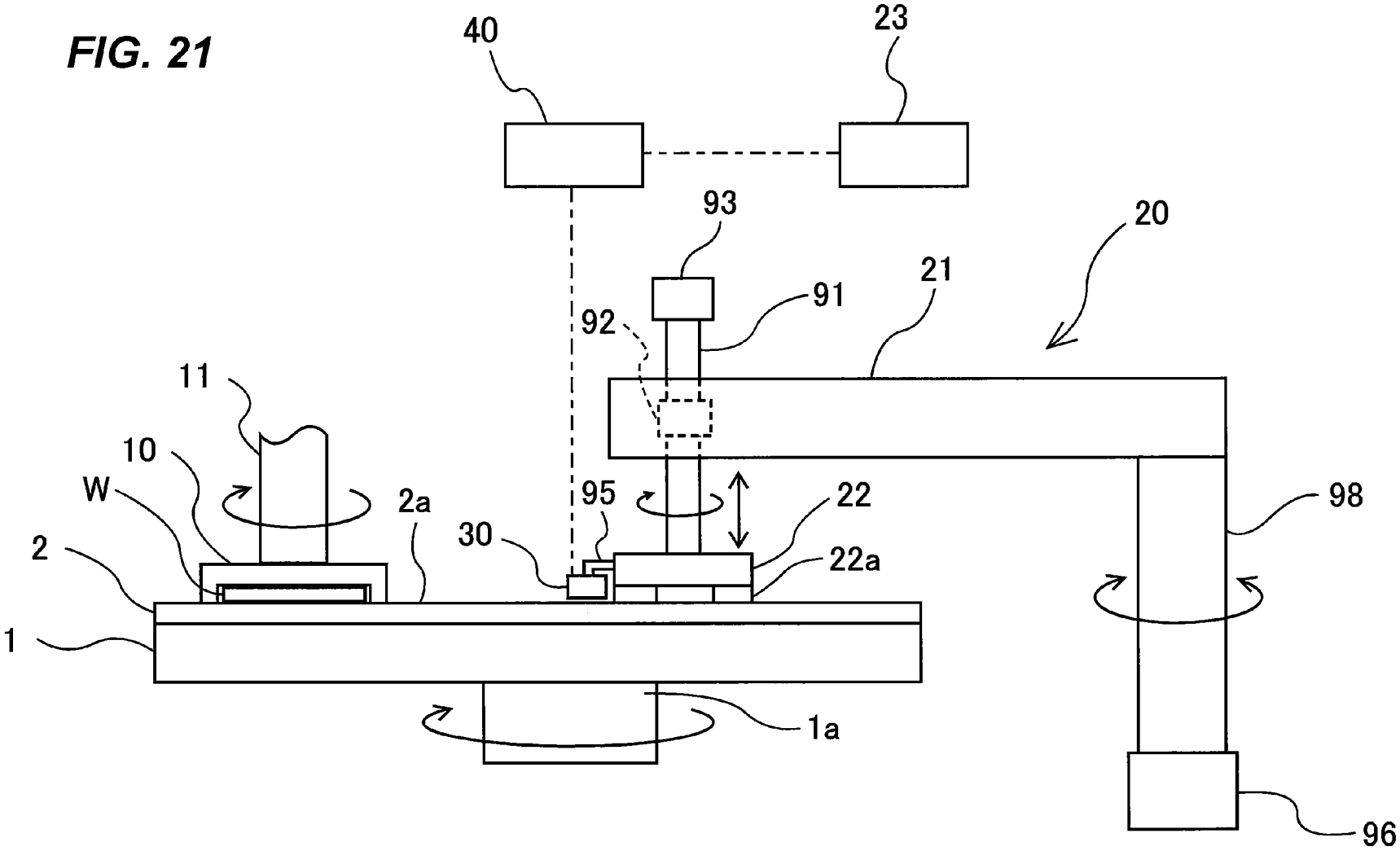
FIG. 21 is a schematic view showing the polishing apparatus according to still another embodiment.
Figure 22:
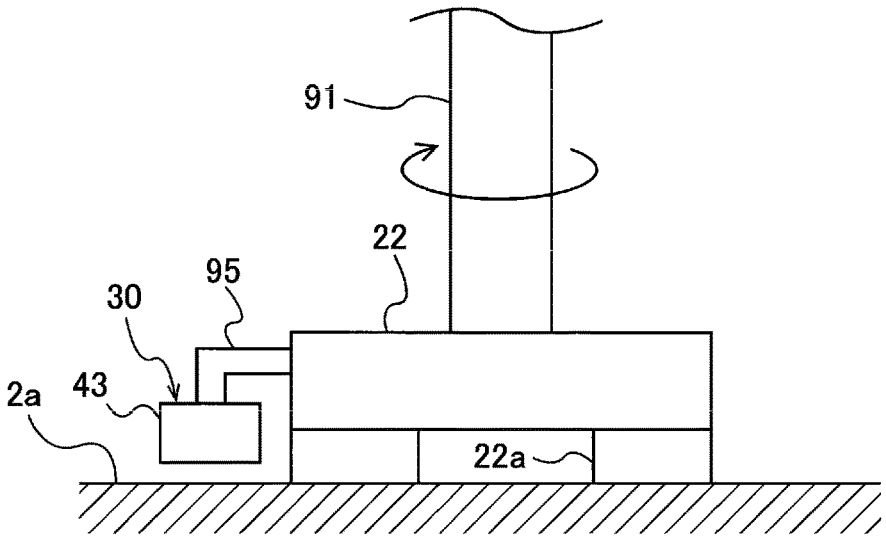
FIG. 22 is an enlarged schematic view showing a dresser shown in FIG. 21.
Figure 23:
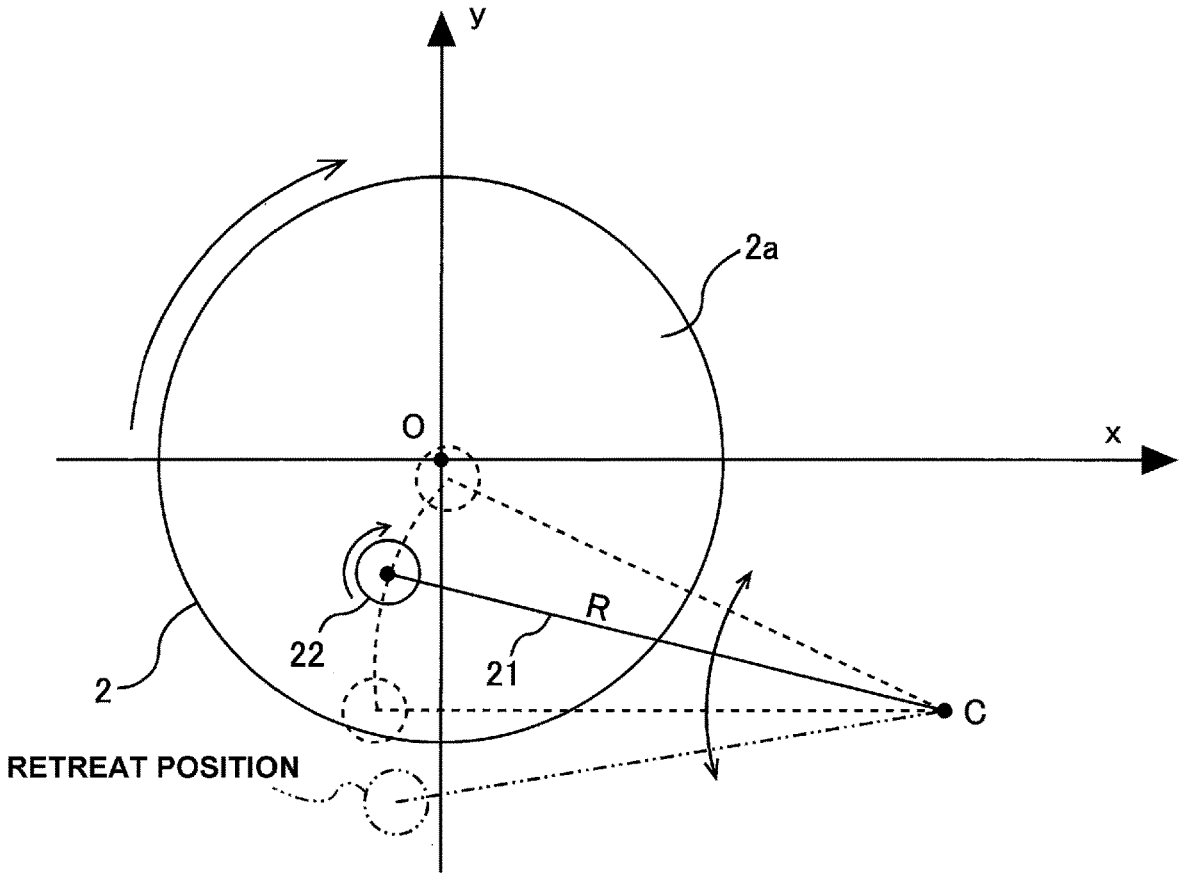
FIG. 23 is a plan view schematically showing a state in which the dresser shown in FIG. 21 is oscillated on the polishing pad.

FIG. 21 is a schematic view showing the polishing apparatus according to still another embodiment. FIG. 22 is an enlarged schematic view showing the dresser shown in FIG. 21, and FIG. 23 is a plan view schematically showing a state in which the dresser shown in FIG. 21 is oscillated on the polishing pad. The configuration of the present embodiment which will not be particularly described is the same as that of the embodiments described above. Thus identical or corresponding parts are denoted by identical reference numerals and their repetitive explanations will be omitted.

The polishing apparatus shown in FIG. 21 has a polishing unit including a polishing table 1 to which a polishing pad 2 is attached, a carrier 10, and the like, and a dressing apparatus 20, as with the polishing apparatus shown in FIG. 1. The dressing apparatus 20 shown in FIG. 21 includes a dresser arm 21, a dresser 22 which is rotatably attached to the dresser arm 21, a dresser shaft 91 coupled to the dresser 21, and a pneumatic cylinder 93 provided at an upper end of the dresser shaft 91. The dresser shaft 91 is rotatably supported by the dresser arm 21, and is rotated by a motor (not shown) installed in the dresser arm 21. Thus, the dresser 22 is rotated about its axis by the rotation of the dresser shaft 91. In the present embodiment, the dressing member 22*a* provided at the lower part of the dresser 22 has a ring shape. However, the dressing member 22*a* may have a circular shape.

The pneumatic cylinder 93 is coupled to a gas supply source (not shown), and serves as a device which applies a dressing load on the polishing pad 2 to the dresser 22. The dressing load can be regulated by an air pressure supplied to the pneumatic cylinder 93. Further, the pneumatic cylinder 93 allows the dresser 22 to be separated from the polishing surface 2*a* of the polishing pad 2. The pneumatic cylinder 93 functions as an elevating actuator to move the dresser shaft 91 and the dresser 22 up and down with respect to the dresser arm 21. In one embodiment, a ball-screw mechanism may be used as the elevating actuator to move the dresser shaft 91 and the dresser 22 up and down with respect to the dresser arm 21.

Further, the dressing apparatus 20 has a support shaft 98 coupled to the dresser arm 21, and a motor (rotating actuator) 96 to rotate the support shaft 98. The dresser arm 21 is configured so as to pivot on a support shaft 98 by actuation of a motor 96.

Dressing of the polishing surface 2*a* of the polishing pad 2 is performed as follows. The polishing table 1 and the polishing pad 2 are rotated by the polishing table rotating motor (not shown), while a dressing liquid (e.g., pure water) is supplied from a dressing liquid supply nozzle (not shown) onto the polishing surface 2*a* of the polishing pad 2. Further, the dresser 22 is rotated about its axis. The dresser 22 is pressed against the polishing surface 2*a* by the pneumatic cylinder 93 so that the lower surface of the dressing member 22*a* is brought into sliding contact with the polishing surface 2*a*. In this state, the dresser arm 21 pivots to move the dresser 22 on the polishing pad 2 in an approximately radial direction of the polishing pad 2. As show in FIG. 23, the polishing table 1 and the polishing pad 2 thereon rotate about an origin (a center point of the polishing pad 2) 0. On the other hand, the dresser 22 rotates through a predetermined angle about a point C whose position corresponds to a central position of the support shaft 98 shown in FIG. 21 (i.e., the dresser 50 pivots). The polishing pad 2 is scraped away by the rotating dresser 22, so that dressing of the polishing surface 2*a* is performed.

As shown in FIGS. 21 and 22, the polishing apparatus has the surface-property measuring device 30 mounted to the dresser 22. The surface-property measuring device 30 shown in FIG. 22 is fixed to a tip of a sub-arm 95 attached to an outer peripheral surface of the dresser 22. A terminal end of the sub-arm 95 is fixed to the outer peripheral surface of the dresser 22. In the present embodiment, the dresser arm 21 is used as the support arm for supporting the surface-property measuring device 30, and the surface-property measuring device 30 is supported by the dresser arm 21 via the sub-arm 92, the dresser 22, and the dresser shaft 91.

The surface-property measuring device 30 shown in FIG. 22 may have the internal structure (measuring structure) described with reference to FIGS. 3 and 4, or may have the internal structure (measuring structure) described with reference to FIGS. 5 and 19. Hereinafter, the internal structure described with reference to FIG. 3 and 4 may be simply refer to as "said measuring structure". Further, the surface-property measuring device 30 may have the housing 43 in which said measuring structure or the imaging device 39 is housed. Although the housing 43 has any shape, the housing 43 described with reference to FIGS. 7A and 7B may be used as this housing 43. Alternatively, the housing 43 may have a cylindrical shape.

In one embodiment, the surface-property measuring device 30 may be housed inside the sub-arm 95. In this case, said measuring structure or the imaging device 39 is disposed within the sub-arm 95, and the sub-arm 95 has an opening formed at a tip thereof. In the case where the surface-property measuring device 30 has said measuring structure, the laser beam emitted by the light emitter 32 reaches to the surface of the polishing pad 2 through the opening formed in the sub-arm 95, and the reflected light that is reflected by the surface of the polishing pad 2 is received by the light receiver 33 through the opening formed in the sub-arm 95. In the case where the surface-property measuring device 30 has the imaging device 39, the imaging device 39 acquires the image information of the surface of the polishing pad 2 through the opening formed in the sub-arm 95.

Further, the surface-property measuring device 30 may have the nozzle 45 described with reference to FIG. 8. As described above, the nozzle 45 is configured to blow a pressurized gas (e.g., pressurized nitrogen or pressurized air) to the polishing surface 2*a* of the polishing pad 2, so that the liquid, such as the polishing liquid or the dressing liquid, is removed by the pressurized gas blown from the nozzle 45. Although not shown, the pressurized-gas supply line for supplying the pressurized gas to the nozzle 45 is coupled to the dresser shaft 91 via a rotary joint or the like, for example, and the pressurized gas is supplied to the surface-property measuring device 30 through flow-passages formed inside the dresser shaft 91, the dresser 22, and the sub-arm 95.

As shown in FIG. 22, when the dressing member 22*a* of the dresser 22 is in contact with the polishing surface 2*a* of the polishing pad 2, the surface-measuring device 30 is away from the polishing surface 2*a*. In the present embodiment, a positon of the surface-property measuring device 30 when the dressing member 22*a* of the dresser 22 is in contact with the polishing surface 2*a* of the polishing pad 2 is the measure positon described above. Since the surface-property measuring device 30 is fixed to the tip of the sub-arm 95, a distance between the surface-property measuring device 30 at the measure position and the polishing surface 2*a* of the polishing pad2 is constant at all times. Therefore, the surface-property measuring device 30 can measure the accurate surface properties of the polishing surface 2*a* of the polishing pad 2.

As described above, the pneumatic cylinder (elevating actuator) 93 allows the dresser 22 to be moved above the polishing surface 2*a* of the polishing pad 2. In the present embodiment, a position where the dressing member 22*a* of the dresser 22 is separated from polishing surface 2*a* of the polishing pad 2 upward is the retreat position, and the moving mechanism for moving the surface-property measuring device 30 from the measure position to the retreat position is the pneumatic cylinder 93. In one embodiment, after the pneumatic cylinder 93 moves the dresser 22 and the surface-property measuring device 30 above the polishing surface 2*a* of the polishing pad 2, the motor (rotating actuator) 96 may move the dresser 22 and the surface-property measuring device 30 to a lateral position of the polishing pad 2 (see the dresser illustrated as double-dotted line in FIG. 23). In this case, the retreat position of the surface-property measuring device 30 is the lateral position of the polishing pad 2, and the moving mechanism is constructed of a combination of the pneumatic cylinder 93 and the motor 96.

Although not shown, when the dressing member 22*a* of the dresser 22 is brought in contact with the polishing surface 2*a* of the polishing pad 2, the surface-property measuring device 30 may be in contact with the polishing surface 2*a* of the polishing pad 2. In this case, a position where the surface-property measuring device 30 is in contact with the polishing pad 2 is the measure position of the surface-property measuring device 30. The surface-property measuring device 30 is preferably coupled to the sub-arm 95 via the attitude adjustment mechanism 70 described with reference to FIGS. 14A and 14B. By the attitude adjustment mechanism 70, the attitude of the surface-property measuring device 30 to be in contact with the polishing surface 2*a* is adjusted so as to become the lower surface thereof to be parallel to the polishing surface 2*a* of the polishing pad 2. The retreat position of the surface-property measuring device 30 in this case is a position where the surface-property measuring device 30 is separated from the polishing surface 2*a* of the polishing pad 2, or a position where the dresser 22 and the surface-property measuring device 30 is moved to the lateral position of the polishing pad 2.

Measuring of the surface properties of the pad by use of the surface-property measuring device 30 may, during polishing of the substrate W, or dressing of the polishing pad 2, move the surface-property measuring device 30 to the measure position and be performed. In this case, the surface-property measuring device30 measures the surface properties of the polishing pad 2 while being rotated together with the dresser 22.

As shown in FIG. 21, the polishing apparatus has a rotary encoder 92 capable of measuring an angle of rotation of the dresser 22 via the dresser shaft 91. The rotary encoder 92 allows a relative position of the rotating surface-property measuring device 30 with respect to the polishing pad 2 to be detected. More specifically, during dressing of the polishing pad 2, the surface-property measuring device 30 is rotated together with the dresser 22. In this case, the surface-property measuring device 30 alternately passes above the polishing pad 2 before being dressed by the dresser 22, and above the polishing pad 2 after being dressed by the dresser 22. The surface-property measuring device 30 measures the surface properties of the polishing pad 2 at predetermined time intervals, and transmits the measured value to the controller 23 (see FIG. 1) every time the surface properties are measured.

The rotary encoder 92 is also connected to the controller 23, and the rotary encoder 92 transmits the relative position of the surface-property measuring device 30 with respect to the polishing pad 2, to the controller 23. The controller 23 divides, based on the relative position transmitted, a plurality of surface property values of the pad obtained by the surface-property measuring device 30 into surface property values of the pad before dressing and surface property values of the pad after dressing. Further, the controller 23 compares the surface property values of the pad after dressing with the surface property values of the pad before dressing, and then calculates suitable dressing conditions based on those comparisons. For example, the dressing conditions are calculated so that a difference between the surface property values before and after dressing remains within a preset predetermined range. In this case, the controller 23 obtains a relational expression showing a relation between the dressing conditions and the difference between the surface property values of the pad before and after dressing in advance, and determines suitable dressing conditions by the above expression.

In one embodiment, a position of the surface-property measuring device 30 when the dressing member 22*a* is away from the surface of the polishing pad 2 upwardly may be the measure position. In this case, the retreat position of the surface-property measuring device 30 is a position of the surface-property measuring device 30 when the dressing member 22*a* is further away from the surface of the polishing pad 2 upwardly, or a position where the dresser 22 and the surface-property measuring device 30 are moved to the lateral position of the polishing pad 2. In the present embodiment, with the dresser 22 and the surface-property measuring device 30 away from the polishing pad 2, the dresser 22 is moved from the periphery to the center of the polishing pad 2 by use of the dresser arm 21 without rotating the dresser 22. The surface-property measuring device 30 measures the surface properties of the polishing pad 2 at predetermined time intervals while moving from the periphery to the center of the polishing pad 2 together with the dresser 22, and transmits the measured values to the controller 23. The controller 23 calculates suitable dressing conditions based on the surface property values of the pad transmitted from the surface-property measuring device 30.

Figure 24A:
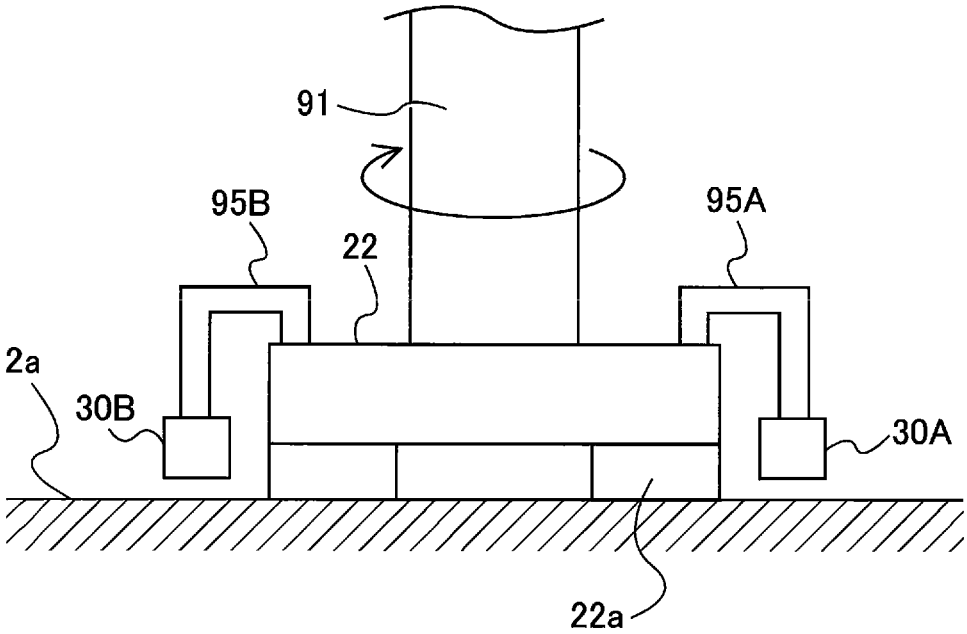
FIG. 24A is a schematic view showing a modified example of the dresser of the polishing apparatus shown in FIG. 21.
Figure 24B:
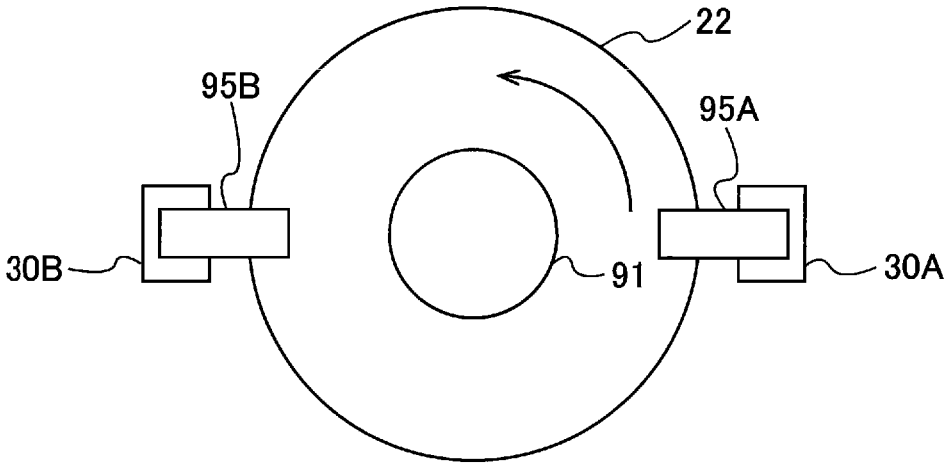
FIG. 24B is a top view of the dresser shown in FIG. 24A.

FIG. 24A is a schematic view showing a modified example of the dresser of the polishing apparatus shown in FIG. 21, and FIG. 24B is a top view of the dresser shown in FIG. 24A. The configuration of the present embodiment which will not be particularly described is the same as that of the dresser 22 shown in FIG. 21, and thus a duplicate description thereof will be omitted.

To the dresser 22 of the polishing apparatus shown in FIGS. 24A and 24B, a plurality of (two in the illustrated example) surface-property measuring devices 30A, 30B are mounted. The surface-property measuring devices 30A, 30B are symmetrically arranged with respect to the center of the dresser 22. The sub-arms 95 for coupling each surface-property measuring device 30 to the dresser 22 have a substantially J-shape, respectively, and ends of each sub-arm 95 are fixed to the upper surface of the dresser 22.

Although, in the present embodiment, the two surface-property measuring devices 30A, 30B are mounted on the dresser 22, three or more surface-property measuring devices may be mounted on the dresser 22. For example, four surface-property measuring devices may be arranged at 90° intervals along the outer peripheral surface of the dresser 22. Hereinafter, the surface-property measuring devices 30A, 30B may be referred to simply as "the surface-property measuring device 30" when there is no need to particularly distinguish between them.

Each surface-property measuring device 30 may have the same measuring structure, or different measuring structures from each other. For example, some (for example, the surface-property measuring device 30A) of the plurality of surface-property measuring devices 30 may be the surface-property measuring devices having the measuring structure described with reference to FIG. 3 or 4, while the remaining surface-property measuring devices 30 (for example, the surface-property measuring device 30B) may be the surface-property measuring devices having the imaging device 39 described with reference to FIGS. 5 and 19.

As with the embodiments described above, the plurality of surface-property measuring devices 30 is being rotated together with the dresser 22 during dressing of the polishing pad 2, and each surface-property measuring devices 30 measures the surface properties of the polishing pad 2 at predetermined time intervals. Every time the surface properties of the polishing pad 2 are measured, each surface-property measuring devices 30 transmits the measured values to the controller 23. The controller 23 divides, based on the relative positions of each surface-property measuring devices 30 with respect to the polishing pad 2, a plurality of surface property values of the pad obtained by each surface-property measuring devices 30 into surface property values of the pad before dressing and surface property values of the pad after dressing. Further, the controller 23 compares the surface property values of the pad before and after dressing, and then calculates suitable dressing conditions based on those comparisons. According to the present embodiment, since the plurality of surface-property measuring devices 30 are mounted to the dresser 22, an amount of data on the difference of the surface property values before and after dressing which are obtained in the controller 23 is greater than the embodiment in which one surface-property measuring device is mounted to the dresser 22. Therefore, the controller 23 can calculate more suitable dressing conditions.

Figure 25:
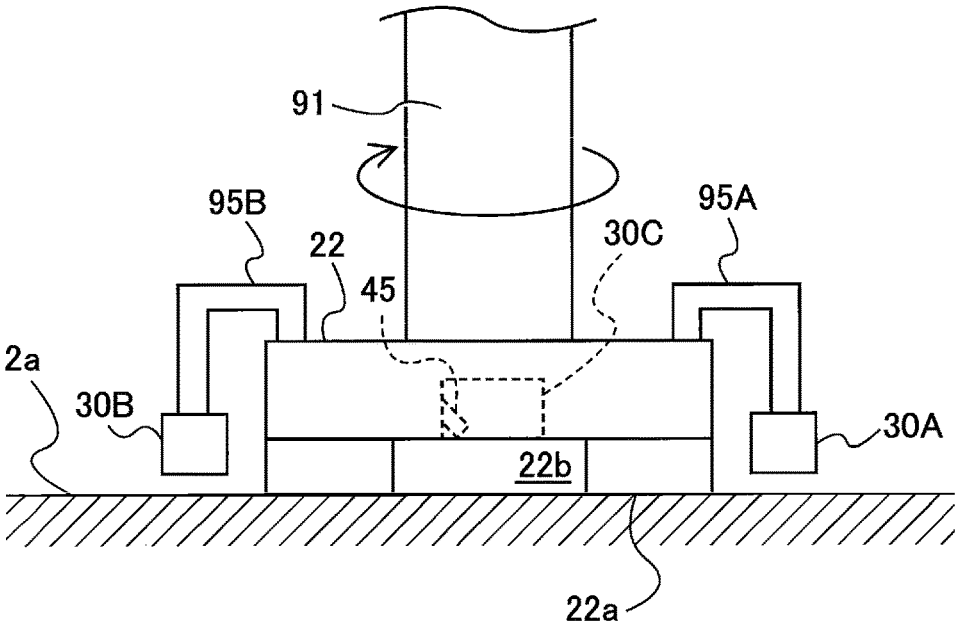
FIG. 25 is a schematic view showing a modified example of the dresser shown in FIGS. 24A and 24B.

FIG. 25 is a schematic view showing a modified example of the dresser shown in FIGS. 24A and 24B. The configuration of the present embodiment which will not be particularly described is the same as that of the embodiment shown in FIGS. 24A and 24B, and thus a duplicate description thereof will be omitted.

To the dresser 22 shown in FIG. 25, three surface-property measuring devices 30A, 30*b*, 30C are mounted. The two surface-property measuring devices 30A, 30B are mounted to the outer peripheral surface of the dresser 22 via the sub-arms 95, respectively, and the surface-property measuring device 30C is disposed in the dresser 22. In the present embodiment, the dressing member 22*a* provided in the dresser 22 has a ring shape. More specifically, the dressing member 22*a* has a through-hole 22*b* extending an upper surface to a lower surface thereof. A recess is formed in a portion of the lower surface of the dresser 22 where the dressing member 22*a* is not provided (in the present embodiment, the center of the lower surface of the dresser 22), and the surface-property measuring device 30C is fitted into the recess.

The surface-property measuring device 30C may have the measuring structure described with reference to FIG. 3 or 4, or have the imaging device 39 described with reference to FIGS. 5 and 19. In one embodiment, the surface-property measuring device 30C may have a housing in which said measuring structure or the imaging device 39 is housed. For example, the housing has a cylindrical shape. In this case, a thread formed in an outer peripheral surface of the housing is engaged with a thread groove which is formed in a wall surface of the recess formed in a lower surface of the dresser 22, thereby mounting the surface-property measuring device 30C to the dresser 22.

The surface-property measuring device 30C measures the surface properties of the polishing pad 2 through the through-hole 22*b* of the dressing member 22*a*. For example, in the case where the surface-property measuring device 30C has said measuring structure, the laser beam emitted by the light emitter 32 reaches to the surface of the polishing pad 2 through the through-hole 22*b* formed in the dressing member 22*a*, and the reflected light that is reflected by the surface of the polishing pad 2 is received by the light receiver 33 through the through-hole 22*b*. In the case where the surface-property measuring device 30C has the imaging device 39, the imaging device 39 acquires the image information of the surface of the polishing pad 2 through the through-hole 22*b* formed in the dressing member 22*a*.

As shown in FIG. 25, the surface-property measuring device 30C may have the nozzle 45 described with reference to FIG. 8. As described above, the nozzle 45 is configured to blow a pressurized gas (e.g., pressurized nitrogen or pressurized air) to the polishing surface 2*a* of the polishing pad 2, and thus the pressurized gas blown from the nozzle 45 causes the liquid, such as the polishing liquid, and the dressing liquid, on the polishing pad 2*a* to be removed. Although not shown, the pressurized-gas supply line for supplying the pressurized gas to the nozzle 45 is coupled to the dresser shaft 91 via the rotary joint or the like, and the pressurized gas is supplied to the surface-property measuring device 30C through flow-passages formed inside the dresser shaft 91, and the dresser 22.

In this manner, in the present embodiment, one surface-property measuring device 30C of the plurality of surface-property measuring device 30A to 30C is disposed within the dresser 22. This surface-property measuring device 30C measures, for example, the surface properties of the polishing pad 2 currently being dressing by the dresser 22. The surface-property measuring device 30C also is connected to the controller 23. The surface-property measuring device 30C measures, during dressing of the polishing pad 2, the surface properties of the polishing pad 2 at predetermined time intervals, and transmits those measured values (i.e., surface property values of the pad) to the controller 23.

As described above, the surface-property measuring devices 30A, 30B measure the surface property values of the pad before and after dressing, and transmits those measured value to the controller 23. Therefore, the controller 23 can obtain the surface property values of the pad before and after dressing which are obtained by the surface-property measuring devices 30A, 30B, and the surface property values of the pad during dressing which are obtained by the surface-property measuring device 30C. As a result, the controller 23 can calculate more suitable dressing conditions based on the surface property values of the pad before and after dressing as well as the surface property values of the pad during dressing.

Figure 26:
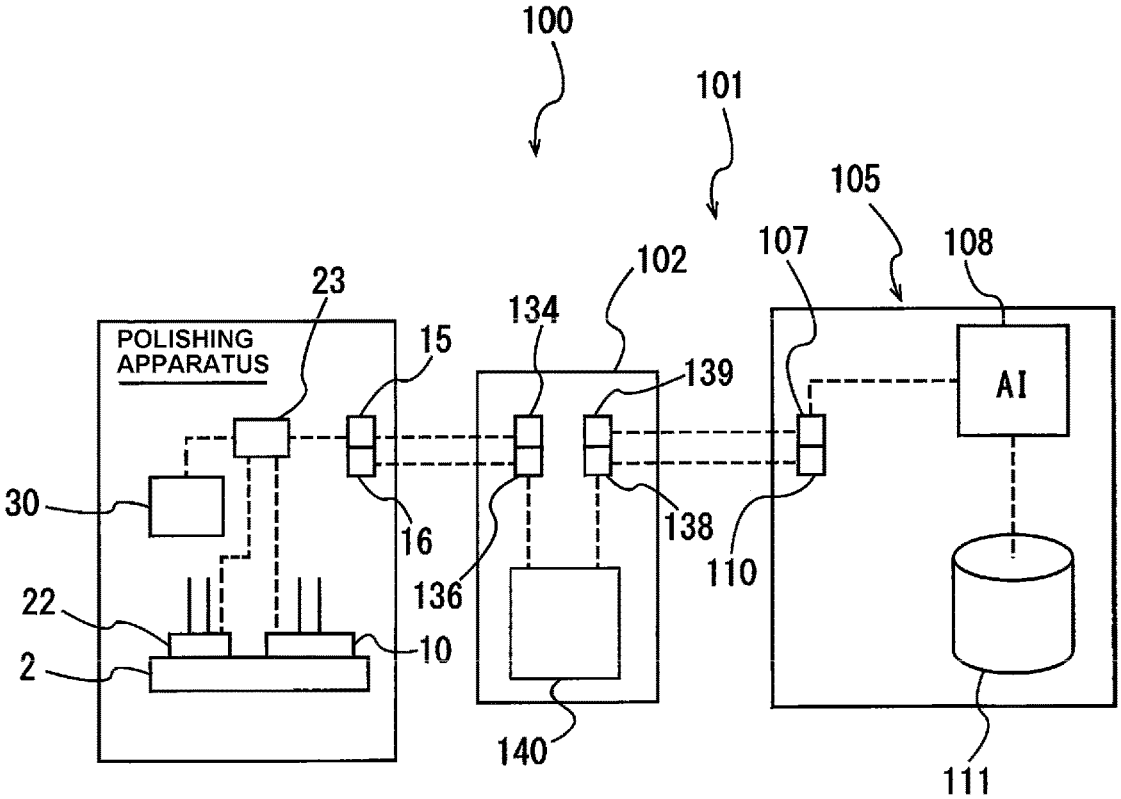
FIG. 26 is a schematic view showing an embodiment of a polishing system which includes the polishing apparatus having the surface-property measuring device.

FIG. 26 is a schematic view showing an embodiment of a polishing system which includes the polishing apparatus having the surface-property measuring device 30. The polishing system shown in FIG. 26 includes the polishing apparatus described with reference to FIGS. 1 through 25, and a polishing-process generation system 101 in which the data of the surface properties of the polishing pad 2 obtained by use of the surface-property measuring device 30 of the polishing apparatus is inputted. The polishing-process generation system 101 shown in FIG. 26 includes a relay device 102 which is connected with the polishing apparatus so as to be capable of transmitting and receiving information with each other, and a processing system 105 which is connected with the relay device 102 so as to be capable of transmitting and receiving information with each other. Thus, the polishing apparatus is connected with the processing system 105 through the relay device 102 so as to be capable of transmitting and receiving information with each other.

In the present embodiment, the polishing apparatus has an output section 15 which outputs various information, such as data of the surface properties of the polishing pad 2. As described above, the polishing apparatus obtains the reflection intensity distribution of the polishing pad 2 by use of the surface-property measuring device 30. The polishing apparatus outputs the reflection intensity distribution obtained from the output section 15 as data representing the surface properties of the polishing pad 2. In one embodiment, the polishing apparatus may obtain the surface property values of the polishing pad based on the reflection intensity distribution obtained by the surface-property measuring device 30, and output those surface property values from the output section 15 as data representing the surface properties of the polishing pad 2.

In the case where the surface-property measuring device 30 has the imaging device 39 (see FIGS. 5 and 19), the polishing apparatus outputs the image information of the polishing pad 2 obtained by the imaging device 39 from the output section 15 as data representing the surface properties of the polishing pad 2. Examples of image data of the polishing pad 2 acquired by the imaging device 39 includes frame image, TDI image, strobe image, and video image. In one embodiment, a plurality of imaging devices 39 are disposed within the casing 43 of the surface-property measuring device 30 to capture three-dimensional images of the polishing surface 2*a*.

The processing system 105 includes an input section 107 in which various information, such as data of the surface properties of the polishing pad 2 is inputted, a processing section 108 which determines dressing conditions of the polishing apparatus based on data of the surface properties of the polishing pad 2 inputted to the input section 107, and an output section 110 which outputs various information, such as dressing condition determined by the processing section 108, to the polishing apparatus. In the present embodiment, the processing section 105 has a transmitting and receiving section in which the input section 107 and the output section 110 are integrally formed. Further, the processing system 105 has a storage section 111, and the storage section 111 can store various data, such as data of the surface properties of the polishing pad 2 inputted to the input section 107.

The processing section 108 of the processing system 105 calculates the surface property values of the polishing pad 2, based on the data of the surface properties of the polishing pad 2, such as the reflection intensity distribution inputted to the input section 107, and calculates suitable dressing conditions based on those values. In the case where the surface property values of the polishing pad 2, which are obtained based on the reflection intensity distribution obtained by the surface-property measuring device 30, are inputted to the input section 107, the processing section 108 calculates suitable dressing conditions based on the surface property values of the polishing pad 2 inputted to the input section 107. In the case where the image information of the polishing pad 2 is inputted to the input section 107 as data representing the surface properties of the polishing pad 2, the processing section 108 calculates suitable dressing conditions based on the image information of the polishing pad 2 inputted to the input section 107.

The processing section 108 obtains, for example, a relational expression showing a relation between the dressing conditions and the surface property values of the pad in advance, and determines suitable dressing conditions by the above expression. As described above, the dressing conditions mainly include a polishing pad rotational speed, a dresser rotational speed, a dressing load, a dresser swinging speed, and the like. The determined dressing conditions are transmitted from the output section 110 to the polishing apparatus through the relay device 102.

The polishing apparatus has an input section 16 to which various information, such as the dressing conditions outputted from the processing system 105, is inputted. In the present embodiment, the polishing apparatus has a transmitting and receiving section in which the input section 16 and the output section 15 are integrally formed. The controller 23 of the polishing apparatus performs the dressing of the polishing pad 2 in accordance with the dressing conditions inputted to the input section 16.

In the present embodiment, the polishing-process generation system 101 has the relay device 102 arranged between the processing system 105 and the polishing apparatus. The relay device 102 serves as a gateway, such as a router, for example. The data of the surface properties of the polishing pad 2 outputted from the output section 15 of the polishing apparatus is transmitted to the input section 107 of the processing system 105 through the relay device 102. The dressing conditions outputted from the output section 110 of the processing system 105 is transmitted to the input section of the polishing apparatus through the relay device 102.

The relay device 102 has an input section to which various information, such as data of the surface properties of the polishing pad 2 outputted from the output section 15 of the polishing apparatus, is inputted, and an output section 136 which outputs various information, such as dressing conditions outputted from the processing system 105, to the input section 16 of the polishing apparatus. In the present embodiment, the relay device 102 has a transmitting and receiving section in which the input section 134 and the output section 136 are integrally formed. Further, the relay device 102 has an output section 139 which outputs various information, such as the data of the surface properties of the polishing pad 2 inputted from the input section 134, to the input section 107 of the processing system 105, and an input section 138 to which various information, such as the dressing conditions outputted from the output section 110 of the processing system, is inputted. The relay device 102 has a processing section 140, and the processing section 140 controls the transmission and reception of information between the polishing apparatus and the relay device 102, and the transmission and reception of information between the relay device 102 and the processing system 105.

The polishing apparatus can be connected with the relay device 102 by wireless communication (for example, high speed WiFi (registered trademark)) or wire communication, and the relay device 102 can be connected with the processing system 105 with the relay device 102 by wireless communication (for example, high speed WiFi (registered trademark)) or wire communication. In the present embodiment, the polishing apparatus is connected with the processing system 105 by a network (for example, Internet) through the relay device 102.

The polishing system 100 may use the surface property values of the pad, which are obtained by the processing system 105, or inputted to the processing system 105, for detection of an abnormality. In this case, the processing section 108 of the processing system 105 determines an occurrence of an abnormality of the surface properties of the pad if the surface property value of the pad and its time-dependent change fall outside preset values (threshold values), and thus outputs an abnormality signal to the polishing apparatus. When the abnormality signal is inputted to the input section 16, the polishing apparatus issues an alarm. In this situation, operation of the polishing apparatus may be stopped.

Further, the polishing system 100 may determine, based on the surface property values of the pad, which are obtained by the processing system 105, or inputted to the processing system 105, a necessity of dressing which represents whether or not the dressing of the polishing pad 2 is required, a necessity of additional dressing which represents whether or not the additional dressing is required, and a replacement of the dresser. In this case, the processing system 105 outputs the necessity of dressing, the necessity of additional dressing, and the replacement of the dresser, and the polishing apparatus is operated according to the inputted information.

For example, the polishing apparatus obtains data of the surface properties of the polishing pad 2 after dressing of the polishing pad 2, and outputs the data to the polishing system 105. The polishing system 105 determines whether or not the dressing of the polishing pad 2 is required (i.e., the necessity of dressing) based on the data of the surface properties after dressing. The processing system 105 outputs the necessity of dressing to the polishing apparatus, and the polishing apparatus controls operations of the dresser based on the determined necessity of dressing. Specifically, when information representing that the dressing is required is inputted to the polishing apparatus, the polishing apparatus performs the dressing of the polishing pad. At this time, the polishing apparatus dresses the polishing pad under the suitable dressing conditions which have been outputted from the processing system 105. When information representing that no dressing is required is input to the polishing apparatus, the polishing apparatus starts polishing of next substrate W without performing the dressing of the polishing pad.

As described above, the surface-property measuring device 30 of the polishing apparatus can obtain data of the surface properties of the polishing pad 2 during polishing of the substrate W, or dressing of the polishing pad 2. Thus, the polishing apparatus transmits data of the surface properties of the polishing pad 2 obtained during dressing of the polishing pad 2, to the processing system 105, and processing section 108 of the processing system 105 modifies, during dressing of the polishing pad 2, dressing conditions based on the data of the surface properties of the polishing pad 2 in the middle of dressing process. The modified dressing conditions are sent to the polishing apparatus, and the polishing apparatus performs dressing of the polishing pad according to the modified dressing conditions.

As shown in FIG. 26, the processing section 108 of the processing system 105 may have an artificial intelligence (AI) function. In this case, the processing section 108 utilizes the artificial intelligence function to predict suitable dressing conditions, necessity of dressing, necessity of additional dressing, and replacement time of the dresser. The processing 108 performs machine learning or deep learning to evaluate surface properties of the pad and surface conditions of the pad, whereby the processing system 105 predicts the suitable dressing conditions, the necessity of dressing, the necessity of additional dressing, and the replacement time of the dresser and outputs those to the polishing apparatus. The processing system 105 can continuously store image information acquired by the surface-property measuring device 30 of the pad in the storage section 111, and use these stored image information as learning data, teacher data, and learning data set.

Further, the processing system 105 may be a cloud computing system or a fog computing system constructed outside a factory in which the polishing apparatus is installed, or be a cloud computing system or a fog computing system constructed inside a factory in which the polishing apparatus is installed.

Such polishing system 100 is constructed by a neural network form or quantum computing form as artificial intelligence. In the polishing system 100, the data (for example, the reflection intensity distribution and image information) representing the surface properties of the polishing pad 2 obtained by the surface-property measuring device 30 of the polishing apparatus is transmitted to the processing system 105 through the relay device 102, such as a router. The processing system 105 utilizes the artificial intelligence function to perform machine learning or deep learning, and thus predicts and outputs to the polishing apparatus the suitable dressing conditions, the necessity of dressing, the necessity of additional dressing.

Machine learning or deep learning uses teacher data. The processing system 105 includes the storage section 111, and this storage section 111 stores in advance teacher data to be compared with the data of the surface properties of the polishing pad 2 inputted to the input section 107. The teacher data includes, for example, data values of the polishing pad 2 for determining dressing conditions, threshold values of data of the polishing pad 2 that requires the replacement of the polishing pad 2, image information of the polishing pad 2 that requires the additional polishing or the replacement of the polishing pad, and the like. The teacher data used for machine learning or deep leaning is normal data, abnormal data, or reference data.

When normal data is used as the teacher data, machine learning or deep learning is performed using the normal data as teacher data to thereby construct a learned model. To the processing section 108 of the processing system 105, the data representing the surface properties of the polishing pad 2 is inputted from the polishing apparatus, and then processing using this learned model is performed. Then, the processing section 108 evaluates the surface properties of the pad. The processing section 108 accumulates data, which is determined to be equivalent to the normal data, as additional teacher data in the storage section 111. Further, the processing section 108 performs the learning based on the teacher data and the additional teacher data to update the learned model for predicting the suitable dressing conditions, the necessity of dressing, the necessity of additional dressing, and the replacement time of the dresser. This learned model is utilized to make prediction with respect to newly inputted data of the surface properties of the polishing pad 2.

When the data representing the surface properties of the polishing pad 2 inputted from the polishing apparatus fall outside a normality determination condition of the learned model obtained, the processing section 108 of the processing system 105 determines that an abnormality of the polishing pad 2 occurs, and outputs an abnormality information to the polishing apparatus.

In this manner, inputting data representing the surface properties of polishing pad 2, such as the reflection intensity distribution, and image information, to the polishing system 100 constructed in the form of a neural network, enables diagnosis results of the pad surface, such as the suitable dressing conditions, the necessity of dressing, the necessity of additional dressing, the replacement time of the dresser, and the abnormality of polishing pad 2, to be provided. In this case, the polishing system 100 takes the data representing the surface properties of the polishing pad 2 as input, and outputs the diagnosis results of the pad surface. In the learning, a combination of the data representing the surface properties of the polishing pad 2, and results of normal/abnormal diagnosis can be used as teacher data. As a result, when there is an abnormal cause in the operation instruction from an operator of the polishing apparatus, it is possible to provide an improvement proposal for the operation. Further, automatic dressing operation is possible in the polishing apparatus.

Even if the data representing the surface properties of the polishing pad 2 has a relatively large volume, the polishing system 100 constructed as artificial intelligence by neural network form or quantum computing form can process a large amount of information. Therefore, the polishing apparatus utilizes the surface-property measuring device 30 to acquire image information of the polishing pad 2 at a plurality of measurement points on the substrate W.

Figure 27A:
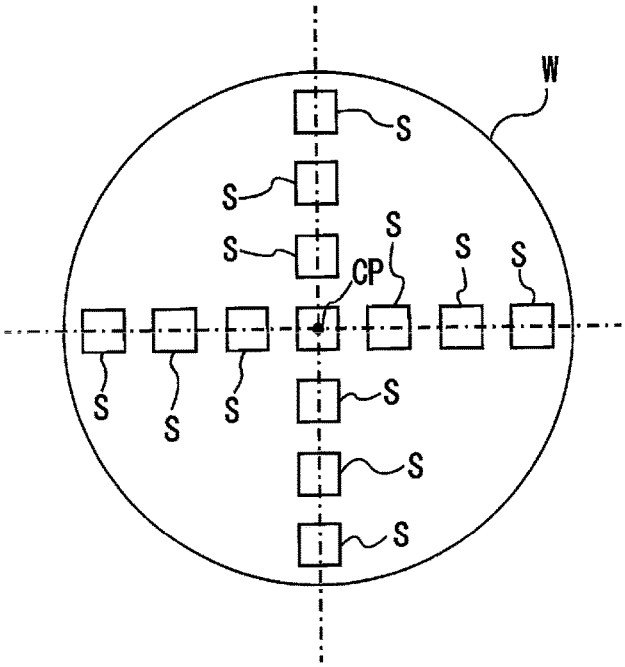
FIG. 27A is a schematic view showing an example of a plurality of measurement points for the surface-property measuring device.
Figure 27B:
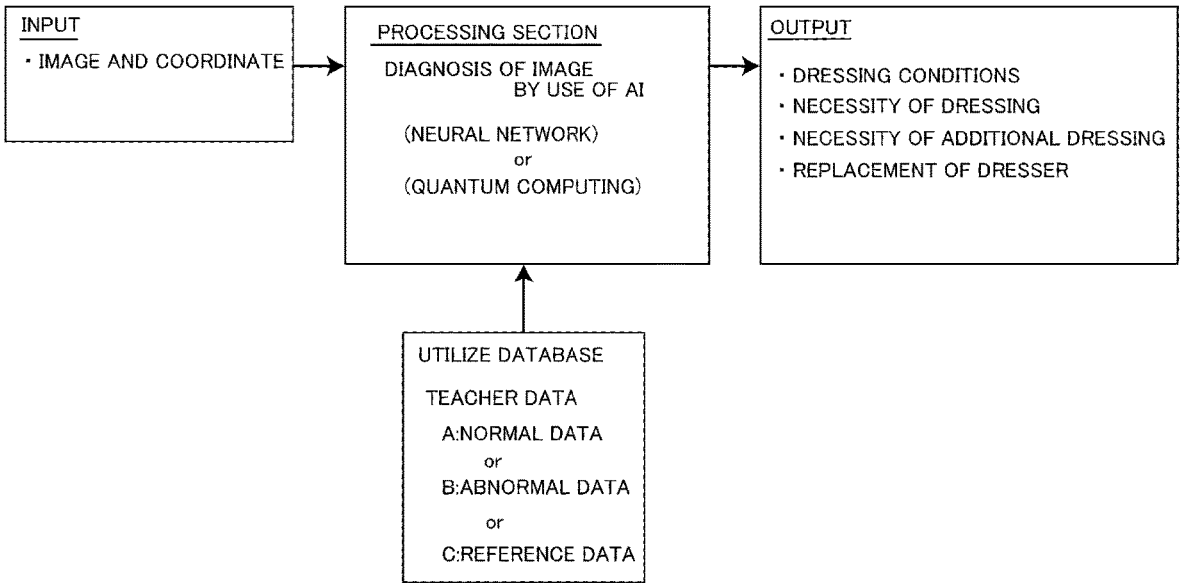
FIG. 27B is a conceptual view showing an overview of operation of the polishing system when processing a plurality of image information of the polishing pad 2 measured at each measurement point shown in FIG. 27A.

FIG. 27A is a schematic view showing an example of the plurality of measurement points for the surface-property measuring device 30, and FIG. 27B is a conceptual view showing an overview of operation of the polishing system when processing a plurality of image information of the polishing pad 2 measured at each measurement point shown in FIG. 27A. In the example shown in FIG. 27A, the surface-property measuring device 30 acquires the image information of the polishing pad 2 at thirteen measurement points S, including a center CP of the substrate W.

As shown in FIG. 27B, the polishing apparatus inputs the plurality of image information of the polishing pad 2 acquired by the surface-property measuring device 30, and each coordinate of the substrate W from which the image information has been acquired, to the processing section 108. The processing section 108 retrieves the learned model stored in the storage section 111, processes the inputted image information of the polishing pad 2 using the learned model, and diagnoses surface properties of the pad corresponding to each coordinate. Further, the processing section 108 outputs the diagnosis results of the pad surface, such as the suitable dressing conditions, the necessity of dressing, the necessity of additional dressing, the replacement time of the dresser, and the abnormality of polishing pad 2, to the polishing apparatus.

According to the polishing system 100 shown in FIG. 26, even when the plurality of image information of the polishing pad 2 is inputted, the diagnosis results of the pad surface can be outputted at a relatively high speed. Further, the plurality of image information is accumulated in the storage section 111 as the additional teacher data, and as a result, the polishing system 100 can improve accuracy in the diagnosis results of the pad surface in a relatively short period.

Figure 28:
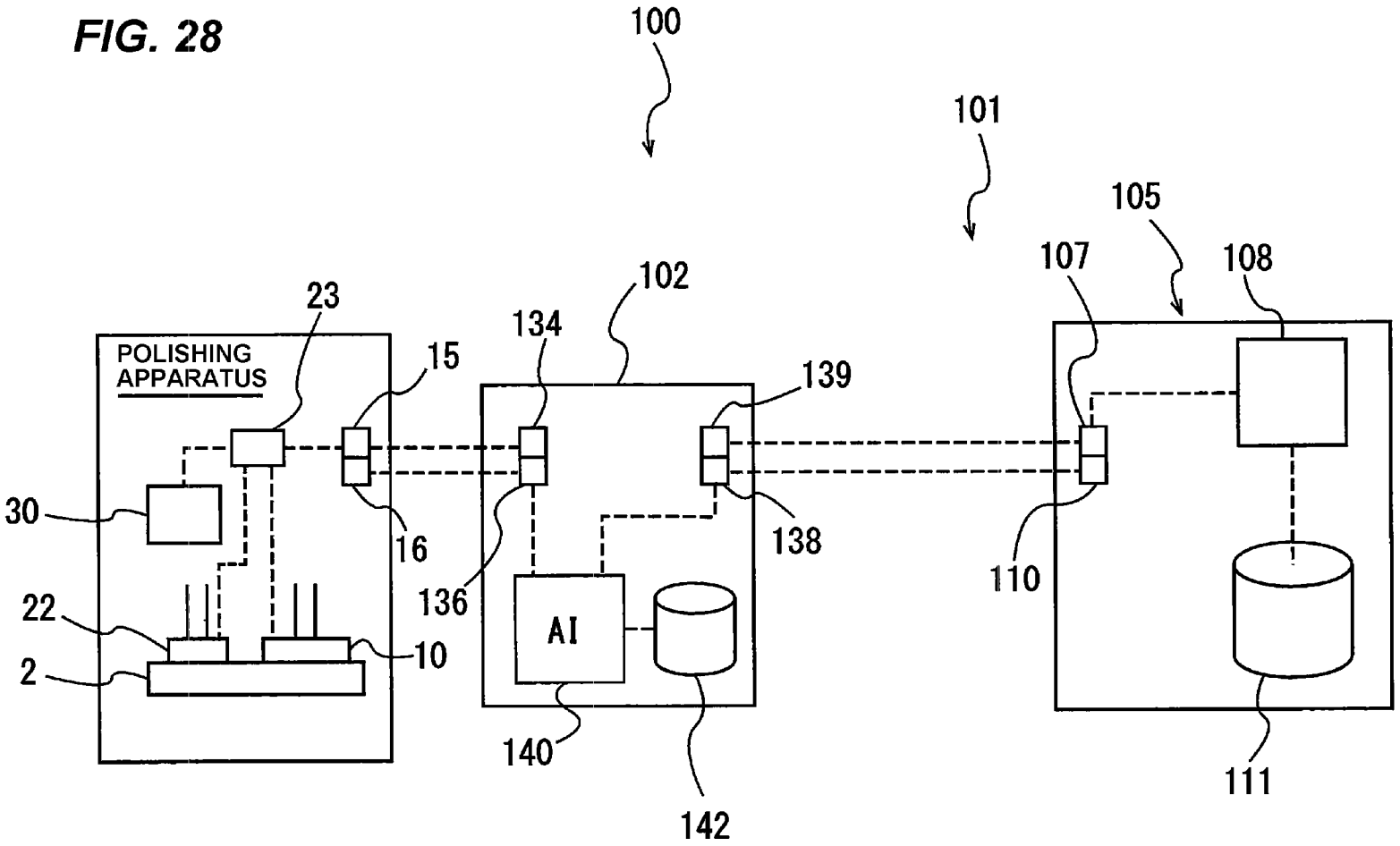
FIG. 28 is a schematic view showing another example of the polishing system which is constructed as artificial intelligence using a neural network form.

FIG. 28 is a schematic view showing another example of the polishing system 100 which is constructed as artificial intelligence using a neural network form (or quantum computing form). The configuration of the present embodiment which will not be particularly described is the same as that of the polishing system 100 shown in FIG. 26, and thus a duplicate description thereof will be omitted.

In the polishing system 100 shown in FIG. 28, the processing section 140 of the relay device 102 has the artificial intelligence (AI) function. This relay device 102 further has a storage section 142 in which various information, such as teacher data, is stored. In the polishing system 100 shown in FIG. 28, the data (for example, the reflection intensity distribution and image information) representing the surface properties of the polishing pad 2 obtained by the surface-property measuring device30 of the polishing apparatus is inputted in the relay device 102. The relay device 102 utilizes the artificial intelligence function to perform machine learning or deep learning, and thus predicts and outputs to the polishing apparatus the suitable dressing conditions, the necessity of dressing, the necessity of additional dressing, and the replacement time of the dresser.

The relay device 102 located in vicinity of the polishing apparatus, and the polishing system 100 is constructed as an edge computing system. Therefore, in the polishing system 100 according to the present embodiment, the relay device 102 can process diagnosis results of the pad surface, such as the suitable dressing conditions, the necessity of dressing, the necessity of additional dressing, the replacement time of the dresser, and the abnormality of polishing pad 2, at high speed, and output to the polishing apparatus. For example, even when image information of the polishing pad 2 at the plurality of measurement points S as shown in FIG. 27A is acquired, and the image information is inputted in the relay device 102, the relay device 102 of the polishing system 100 can process the plurality of image information at high speed to quickly output the diagnosis results of the pad surface to the polishing apparatus. Therefore, even if dressing conditions are to be modified in the middle of dressing process, the relay device 102 can output the suitable dressing conditions based on the image information.

On the other hand, information that is not required to be processed at high speed (for example, status information of the polishing apparatus) can be transmitted from the polishing apparatus to the processing system 105 through the relay device 102. As a result, the processing section 104 of the relay device 102 is not required to perform unnecessary information processing, so that the plurality of image information can be processed at higher speed.

Figure 29:
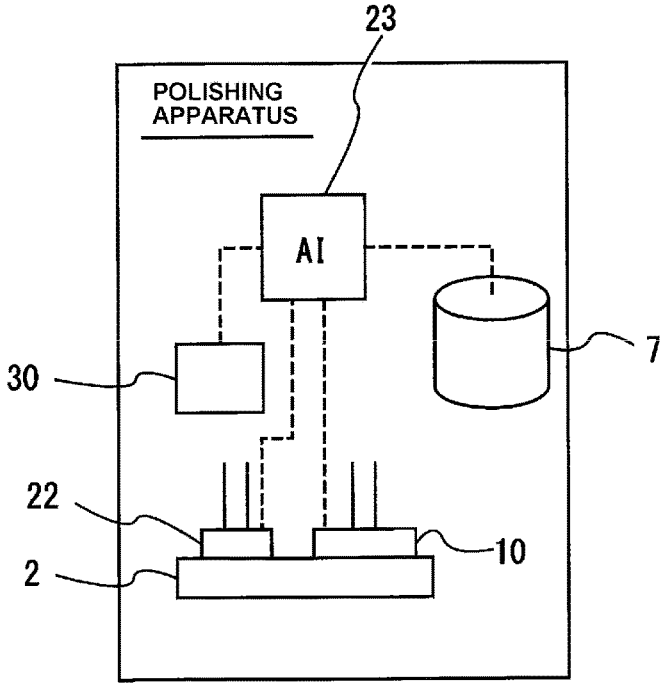
FIG. 29 is a schematic view showing an example of a controller of the polishing apparatus having an artificial intelligence function.
Figure 30:
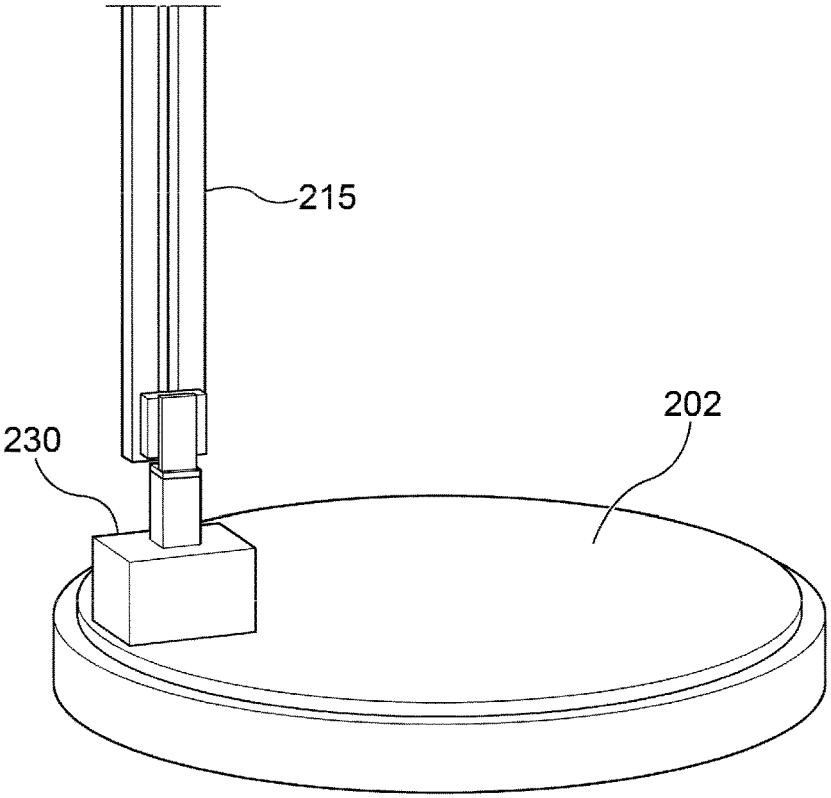
FIG. 30 is a schematic view showing an example of a surface-property measuring device attached to a conventional polishing apparatus.

FIG. 29 is a schematic view showing an example of the controller of the polishing apparatus having an artificial intelligence function. As shown in FIG. 29, the controller 23 of the polishing apparatus may have the artificial intelligence function. The polishing apparatus has a storage section 7, and the storage section 7 stores various information, such as teacher data.

The data representing the surface properties of polishing pad 2, which is obtained by the surface-property measuring device 30 (for example, the reflection intensity distribution, and image information) is inputted in the controller 23 of the polishing apparatus. The controller 23 utilizes the artificial intelligence function to perform machine learning or deep learning, and thus predicts the suitable dressing conditions, the necessity of dressing, the necessity of additional dressing, and the replacement time of the dresser. Further, the controller 23 controls operations of the polishing apparatus according to the suitable dressing conditions, the necessity of dressing, the necessity of additional dressing, and the replacement time of the dresser, which are predicted.

For example, when the controller 23 predicts that the additional dressing is required, the controller 23 further performs the additional dressing after the dressing is completed. The controller 23 predicts suitable dressing conditions for the additional dressing, and dresses the polishing pad 2 according to the suitable dressing conditions.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a polishing apparatus having a surface-property measuring device for measuring surface properties of a polishing pad which is used to polish a substrate, such as a semiconductor wafer, and a polishing system including such a polishing apparatus.

REFERENCE SIGNS LIST

1 polishing table
2 polishing pad
15 output section
16 input section
20 dressing apparatus
22 dresser
23 controller
30 surface-property measuring device
40 processer
43 casing
44 cutout
45 nozzle
47 filter
48 frame
49 motor pedestal
50 support arm
52 support plate
53 moving unit
55 fixed block
56 pivot block
58 rotational shaft
59 motor
60 pivot mechanism
62 piston
63 cylinder
64 first plate
65 second plate
66 rotational pin
67 pin
68 through-hole
69 barrier
70 attitude adjusting mechanism
72 support base
73 adjustment pin
74 through-hole
77, 78 positioning plate
80 displacement mechanism
81 slotted hole
82 support shaft
83 piston-cylinder mechanism
85 piston
86 cylinder
89 first joint
90 second joint
91 dresser shaft
92 rotary encoder
93 pneumatic cylinder (elevating mechnism)
95 sub-arm
96 motor (rotating actuator)
98 support shaft
100 polishing system
102 relay device
105 polishing-process generation system
107 input section
108 processing section
110 output section
111 storage section

What is claimed is:

1. A polishing system, comprising:

a polishing apparatus including a surface-property measuring device configured to generate multiple images of multiple measurement points of a polishing pad that indicate surface properties of the polishing pad, a support arm configured to support the surface-property measuring device, and a moving unit coupled to the support arm and configured to automatically move the surface-property measuring device from a retreat position to a measure position; and a processing system in which the multiple images indicating the surface properties of the polishing pad are inputted, wherein the processing system includes:

an input section in which the multiple images of the multiple measurement points are inputted;

a storage section storing a learned model therein;

a processing section configured to input the multiple images in the learned model to diagnose the surface properties of the polishing pad using the learned model that processes the multiple images, and determine dressing conditions, a necessity of dressing, a necessity of additional dressing, a replacement time of a dresser, and an abnormality of polishing pad, and the polishing apparatus is configured to dress the polishing pad based on the dressing conditions determined by the processing section.

2. The polishing system according to claim 1, wherein the polishing apparatus transmits data of the surface properties of the polishing pad, which are obtained during dressing of the polishing pad, to the input section of the processing system, and the processing section modifies, based on the data of the surface properties of the polishing pad obtained during dressing, the dressing conditions during a dressing process of the polishing pad.

3. The polishing system according to claim 1, wherein the processing system is connected the polishing apparatus through network.

4. The polishing system according to claim 1, wherein the processing section is configured to add the multiple images to a teacher data, and perform machine learning using the teacher data to update the learned model.

* * * * *